US007556168B2

(12) United States Patent
Turner et al.

(10) Patent No.: US 7,556,168 B2
(45) **Date of Patent: *Jul. 7, 2009**

(54) CAN END WITH FOLD

(75) Inventors: Timothy L. Turner, Port Charlotte, FL (US); Randall G. Forrest, Park Ridge, IL (US); Rajesh Gopalaswamy, Alpharetta, GA (US); Michael R. Gogola, Itasca, IL (US)

(73) Assignee: Rexam Beverage Can Company, Chicago, IL (US)

( * ) Notice: Subject to any disclaimer, the term of this patent is extended or adjusted under 35 U.S.C. 154(b) by 390 days.

This patent is subject to a terminal disclaimer.

(21) Appl. No.: 10/846,259

(22) Filed: May 14, 2004

(65) Prior Publication Data

US 2005/0006388 A1 Jan. 13, 2005

Related U.S. Application Data

(63) Continuation-in-part of application No. 10/680,644, filed on Oct. 7, 2003, now Pat. No. 7,174,762, and a continuation-in-part of application No. 10/219,914, filed on Aug. 15, 2002, now Pat. No. 7,004,345, which is a continuation-in-part of application No. 09/931,497, filed on Aug. 16, 2001, now Pat. No. 6,772,900.

(51) Int. Cl.
*B65D 17/34* (2006.01)

(52) U.S. Cl. ..... 220/269; 220/619

(58) Field of Classification Search ..... 220/269, 220/619, 620, 623, 624; 413/4, 11, 17
See application file for complete search history.

(56) References Cited

U.S. PATENT DOCUMENTS 3,186,583 A 6/1965 Zundel (Continued)

FOREIGN PATENT DOCUMENTS

DE 2 303 943 5/1974

(Continued)

OTHER PUBLICATIONS

U.S. Appl. No. 09/863,160, Fields, filed Nov. 8, 2001.

(Continued)

*Primary Examiner*—Robin Hylton
(74) *Attorney, Agent, or Firm*—Ungaretti & Harris LLP

(57) ABSTRACT

A can end member has a center panel, a circumferential chuck wall, and a transition wall. The center panel is centered about a longitudinal axis and has a peripheral edge. The center panel also has a step portion located radially outwardly from the longitudinal axis. The step portion has an annular convex portion joined to an annular concave portion and displaces at least a portion of the center panel vertically in a direction parallel to the longitudinal axis. The curl defines an outer perimeter of the end member. The circumferential chuck wall extends downwardly from the curl to the transition wall. The transition wall connects the chuck wall with the peripheral edge of the center panel. The transition wall comprises a folded portion. The folded portion has a first leg, a second leg, and a third leg. The first leg is directly connected to the chuck wall and joined to the second leg by a concave annular portion. The second leg is joined to the third leg by a convex annular portion, and the third leg is joined to the center panel. The convex annular portion has a radius of curvature greater than 0.002 ins.

22 Claims, 30 Drawing Sheets

U.S. PATENT DOCUMENTS

| | | | | | |
|---|---|---|---|---|---|
| 3,434,623 | A | | 3/1969 | Cookson | |
| 3,525,455 | A | | 8/1970 | Saunders | |
| 3,705,563 | A | | 12/1972 | Elser | |
| 3,765,352 | A | | 10/1973 | Schubert et al. | |
| 3,837,524 | A | | 9/1974 | Schubert et al. | |
| 3,853,080 | A | | 12/1974 | Zundel | |
| 3,868,919 | A | | 3/1975 | Schrecker et al. | |
| 3,871,314 | A | | 3/1975 | Stargell | |
| 3,905,513 | A | | 9/1975 | Klein | |
| 3,941,277 | A | | 3/1976 | McKinney et al. | |
| 3,945,334 | A | | 3/1976 | Ostrem et al. | |
| 3,990,376 | A | | 11/1976 | Schubert et al. | |
| 4,031,837 | A | | 6/1977 | Jordan | |
| 4,055,134 | A | | 10/1977 | Ostrem et al. | |
| 4,084,721 | A | | 4/1978 | Perry | |
| 4,093,102 | A | | 6/1978 | Kraska | |
| 4,116,361 | A | | 9/1978 | Stargell | |
| 4,217,843 | A | | 8/1980 | Kraska | |
| 4,262,815 | A | | 4/1981 | Klein | |
| 4,324,343 | A | | 4/1982 | Moller | |
| 4,434,641 | A | | 3/1984 | Nguyen | |
| 4,448,322 | A | | 5/1984 | Kraska | |
| 4,571,978 | A | | 2/1986 | Taube et al. | |
| 4,577,774 | A | | 3/1986 | Nguyen | |
| 4,641,761 | A | | 2/1987 | Smith et al. | |
| 4,680,917 | A | | 7/1987 | Hableton et al. | |
| 4,685,849 | A | | 8/1987 | LaBarge et al. | |
| 4,704,887 | A | | 11/1987 | Bachmann et al. | |
| 4,722,215 | A | | 2/1988 | Taube et al. | |
| 4,804,106 | A | | 2/1989 | Saunders | |
| 4,832,223 | A | | 5/1989 | Kalenak et al. | |
| 4,991,735 | A | | 2/1991 | Biondich | |
| 5,069,355 | A | | 12/1991 | Matuszak | |
| 5,105,977 | A | | 4/1992 | Taniuchi | |
| 5,143,504 | A | | 9/1992 | Braakman | |
| 5,174,706 | A | | 12/1992 | Taniuchi | |
| 5,346,087 | A | * | 9/1994 | Klein | 220/268 |
| 5,823,730 | A | | 10/1998 | La Rovere | |
| 5,950,858 | A | | 9/1999 | Sergeant | |
| 5,964,366 | A | * | 10/1999 | Hurst et al. | 220/269 |
| 6,024,239 | A | | 2/2000 | Turner et al. | |
| 6,065,634 | A | | 5/2000 | Brifcani et al. | |
| 6,089,072 | A | | 7/2000 | Fields | |
| 6,234,337 | B1 | | 5/2001 | Huber et al. | |
| 6,296,137 | B1 | | 10/2001 | Bjornsen | |
| 6,419,110 | B1 | | 7/2002 | Stodd | |
| 6,425,721 | B1 | | 7/2002 | Zysset | |
| 6,499,622 | B1 | | 12/2002 | Neiner | |
| 6,772,900 | B2 | * | 8/2004 | Turner et al. | 220/269 |
| 7,004,345 | B2 | * | 2/2006 | Turner et al. | 220/269 |
| 7,036,348 | B2 | | 5/2006 | McClung | |
| 7,174,762 | B2 | * | 2/2007 | Turner et al. | 72/348 |
| 7,350,392 | B2 | * | 4/2008 | Turner et al. | 72/379.4 |
| 2002/0158071 | A1 | | 10/2002 | Chasteen et al. | |
| 2004/0065663 | A1 | * | 4/2004 | Turner et al. | 220/254.1 |
| 2004/0200838 | A1 | * | 10/2004 | Turner et al. | 220/269 |
| 2004/0211780 | A1 | * | 10/2004 | Turner et al. | 220/270 |

FOREIGN PATENT DOCUMENTS

| | | | |
|---|---|---|---|
| DE | 25 54 264 | | 6/1977 |
| DE | 8228681 | | 10/1983 |
| FR | 2577897 | A1 | 8/1986 |
| WO | WO-03016155 | | 2/1993 |
| WO | WO 96/37414 | | 11/1996 |
| WO | WO 98/34743 | | 8/1998 |
| WO | WO 01/41948 | | 6/2001 |
| WO | WO 02/00512 | | 1/2002 |
| WO | WO02/00512 | | 1/2002 |
| WO | WO02/43895 | | 6/2002 |
| WO | WO 02/057137 | | 7/2002 |
| WO | WO 02/057148 | | 7/2002 |

OTHER PUBLICATIONS

U.S. Appl. No. 09/905,310, Ball et al., filed May 2, 2002.

Great Britian Provisional Specification for "Improvements in or relating to Closured Tins, Jars, or like Containers," Patent No. 422,052, by Robert Barlow, and Arthur Leslie Stuchbery, Complete Specification Accepted: Dec. 31, 1934, Application Date: Jun. 29, 1933.

Australia Complete Specification for "Improvements in the manufacture of tins or sheet metal containers, cans and the like," Patent No. 107,340, by Saml. Hanson & Son, Limited, Accepted: May 3, 1939, Application Date: May 3, 1938.

European Search Report mailed Sep. 4, 2007 in co-pending European Application No. 07012544.8-2308.

* cited by examiner

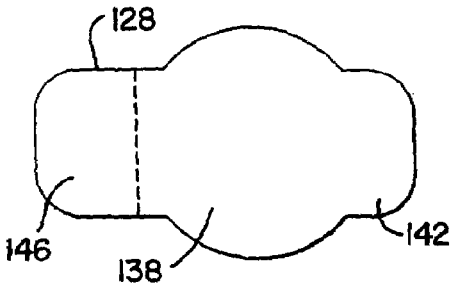
FIG. 18
FIG. 19
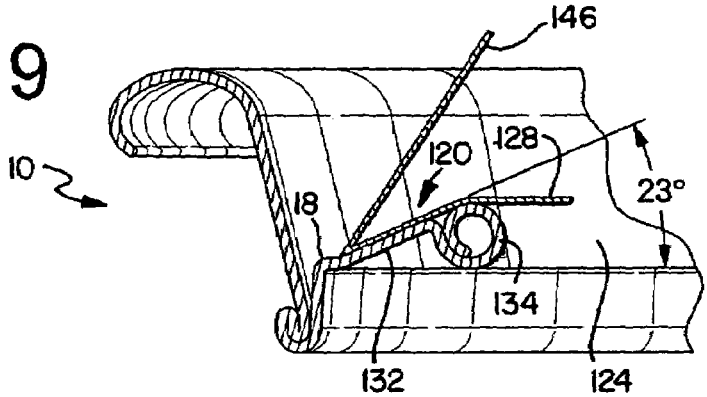
FIG. 20
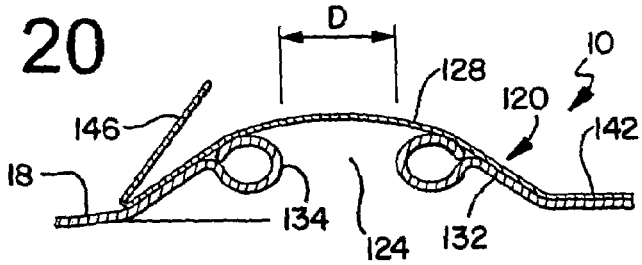
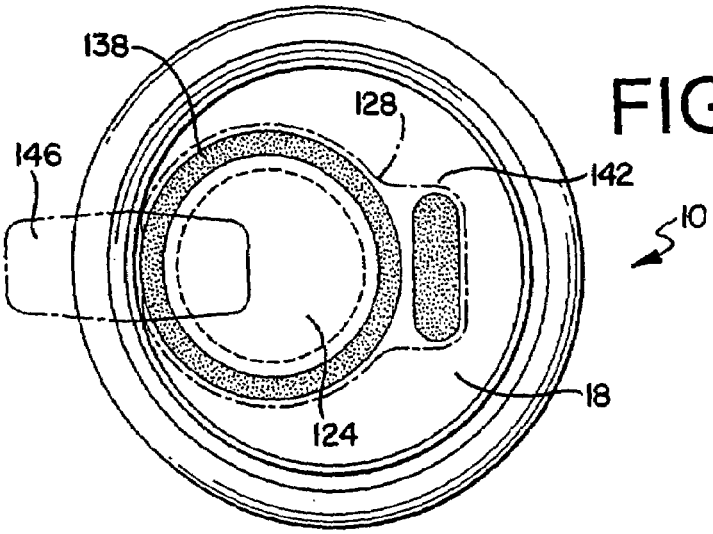
FIG. 21

CAN END WITH FOLD

RELATED APPLICATION

This application is a continuation-in-part of Application Ser. No. 10/680,644 filed on Oct. 7, 2003 and now U.S. Pat. No. 7,174,762 Application Ser. No. 10/219,914, now U.S. Patent No. 7,004,345, filed on Aug. 15, 2002 which was a continuation-in-part of Application Ser. No. 09/931,497, now U.S. Patent No. 6,772,900, which was filed on Aug. 16, 2001. The applications are commonly assigned and incorporated by reference herein.

TECHNICAL FIELD

The present invention relates to end closures for two-piece beer and beverage metal containers having a non-detachable operating panel. More specifically, the present invention relates to a method of reducing the volume of metal in an end closure.

BACKGROUND OF THE INVENTION

Common easy open end closures for beer and beverage containers have a central or center panel that has a frangible panel (sometimes called a "tear panel," "opening panel," or "pour panel") defined by a score formed on the outer surface, the "consumer side," of the end closure. Popular "ecology" can ends are designed to provide a way of opening the end by fracturing the scored metal of the panel, while not allowing separation of any parts of the end. For example, the most common such beverage container end has a tear panel that is retained to the end by a non-scored hinge region joining the tear panel to the reminder of the end, with a rivet to attach a leverage tab provided for opening the tear panel. This type of container end, typically called a "stay-on-tab" ("SOT") end has a tear panel that is defined by an incomplete circular-shaped score, with the non-scored segment serving as the retaining fragment of metal at the hinge-line of the displacement of the tear panel.

The container is typically a drawn and ironed metal can, usually constructed from a thin sheet of aluminum or steel. End closures for such containers are also typically constructed from a cut-edge of thin sheet of aluminum or steel, formed into a blank end, and manufactured into a finished end by a process often referred to as end conversion. These ends are formed in the process of first forming a cut-edge of thin metal, forming a blank end from the cut-edge, and converting the blank into an end closure which may be seamed onto a container. Although not presently a popular alternative, such containers and/or ends may be constructed of plastic material, with similar construction of non-detachable parts provided for openability.

One goal of the can end manufacturers is to provide a buckle resistant end. U.S. Pat. No. 3,525,455 (the '455 patent) describes a method aimed at improving the buckle strength of a can end having a seaming curl, a chuck wall, and a countersink along the peripheral edge of a center panel. The method includes forming a fold along at least substantially the entire length of the chuck wall. The fold has a vertical length that is approximately the same length as the seaming curl, and a thickness that is approximately equal to the length of the remaining chuck wall wherein the fold is pressed against the interior sidewall of the container when the end is seamed to the container's open end.

Another goal of the manufacturers of can ends is to reduce the amount of metal in the blank end which is provided to form the can end while at the same time maintaining the strength of the end. One method aimed at achieving this goal is described in U.S. Pat. No. 6,065,634 (the '634 patent). The '634 patent is directed to a can end member having a seaming curl, a chuck wall extending downwardly from the seaming curl to a countersink which is joined to a center panel of the can end. The method of the '634 patent reduces the amount of metal by reducing the cut edge of the blank. This is accomplished by increasing the chuck wall angle from approximately 11-13 degrees to an angle of 43 degrees.

The method of the '634 patent may decrease the diameter of the center panel. This could reduce area on the center panel that is needed for written instructions, such as opening instructions or recycling information. It may also restrict the size of the tear panel. Furthermore, because the angle of the chuck wall is increased, the space between the perimeter of the can end and the tear panel is increased. This could cause spillage during pouring and/or drinking.

The method of the '634 patent also produces a countersink. The '455 patent shares this aspect. The countersink is provided in the can end to improve strength. However, because the countersink is a narrow circumferential recess, dirt will often collect within the countersink. Additionally, the dirt is often difficult to rinse away due to the geometry of the countersink.

U.S. Pat. No. 5,950,858 (the '858 patent) also discloses a method of strengthening a can end. The '858 patent discloses a can end having a countersink and a folded portion located at the junction of the center panel or within the countersink at the lowermost portion of the countersink. One of the stated benefits of Sergeant is that the fold provides effective resistance against the countersink inverting.

SUMMARY OF THE INVENTION

One object of the present invention is to provide an easy open can end member having sufficient strength and improved cleanliness characteristics. The easy open can end member comprises a center panel, a curl, a circumferential chuck wall, and a transition wall.

The center panel is positioned about a longitudinal axis. It includes a closure member for sealing the end member. A portion of the closure member is retainable to a portion of the center panel once the easy open can end member is opened. The center panel also includes a step portion located radially outwardly from the longitudinal axis. The step portion has an annular convex portion joined to an annular concave portion and displaces at least a portion of the center panel vertically in a direction parallel to the longitudinal axis.

The curl defines an outer perimeter of the end member. The circumferential chuck wall extends downwardly from the curl. The transition wall connects the chuck wall with a peripheral edge of the center panel. The transition wall connects the chuck wall with a peripheral edge of the center panel. The transition wall comprises a folded portion. The folded portion has a first leg, a second leg, and a third leg. The first leg is directly connected to the chuck wall and joined to the second leg by a concave annular portion. The second leg is joined to the third leg by a convex annular portion, and the third leg is joined to the center panel. The convex annular portion has a radius of curvature greater than 0.002 ins.

Other features and advantages of the invention will be apparent from the following specification taken in conjunction with the following drawings.

BRIEF DESCRIPTION OF THE DRAWINGS

FIG. 18 is a top plan view of a peelable closure;

FIG. 19 is a partial cross-sectional view of an embodiment of the can end of the present invention having a peelably bonded closure;

FIG. 20 is a partial cross-sectional view of an embodiment of the can end of the present invention having a peelably bonded closure;

FIG. 21 is a top plan view of a container having a peelable closure;

DETAILED DESCRIPTION

Figure 1:
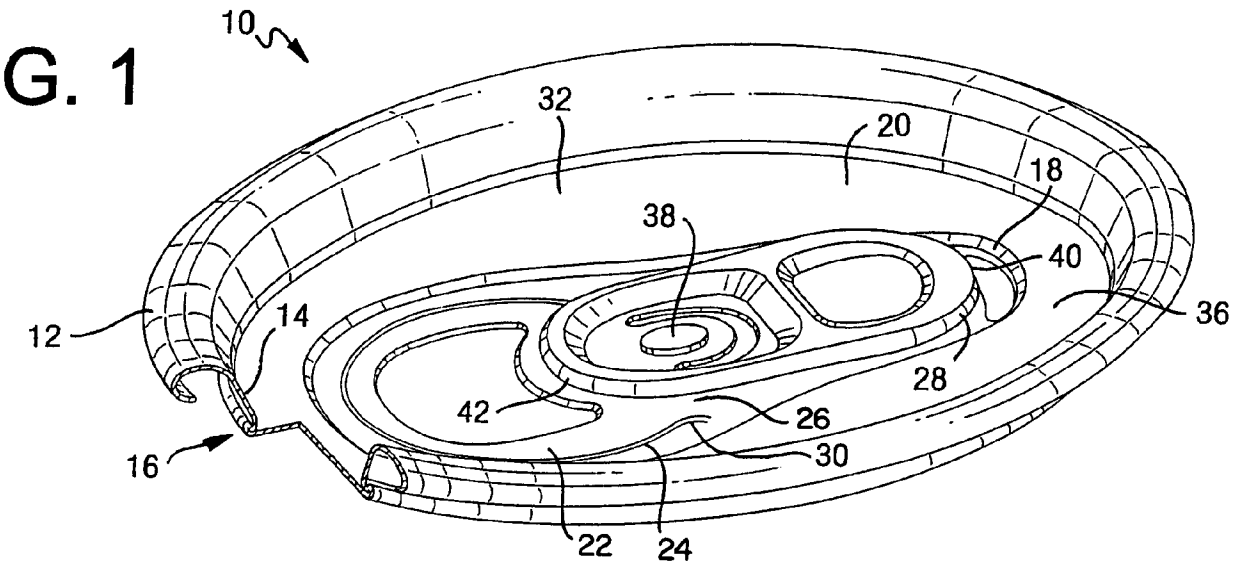
FIG. 1 is a perspective view of a can end of the present invention having a cutaway view of a portion of the perimeter.

While this invention is susceptible of embodiment in many different forms, there are shown in the drawings and will herein be described in detail preferred embodiments of the invention with the understanding that the present disclosure is to be considered as an exemplification of the principles of the invention and is not intended to limit the broad aspect of the invention to the embodiments illustrated.

The container end of the present invention is a stay-on-tab end member 10 with improved physical properties including strength. Essentially, the present invention provides a lightweight end member 10 which embodies the physical characteristics and properties required in the beverage container market, as explained below.

Referring to FIG. 1, the end member 10 for a container (not shown) has a seaming curl 12, a chuck wall 14, a transition wall 16, and center or central panel wall 18. The container is typically a drawn and ironed metal can such as the common beer and beverage containers, usually constructed from a thin sheet of aluminum or steel that is delivered from a large roll called coil stock of roll stock. End closures for such containers are also typically constructed from a cut edge of thin sheet of aluminum or steel delivered from coil stock, formed into blank end, and manufactured into a finished end by a process often referred to as end conversion. In the embodiment shown in the Figures, the end member 10 is joined to a container by a seaming curl 12 which is joined to a mating curl of the container. The seaming curl 12 of the end closure 10 is integral with the chuck wall 14 which is joined to an outer peripheral edge portion 20 of the center panel 18 by the transition wall 16. This type of means for joining the end member 10 to a container is presently the typical means for joining used in the industry, and the structure described above is formed in the process of forming the blank end from a cut edge of metal sheet, prior to the end conversion process. However, other means for joining the end member 10 to a container may be employed with the present invention.

The center panel 18 has a displaceable closure member. In FIG. 1 the displaceable closure member is a conventional tear panel 22. The tear panel 22 is defined by a curvilinear frangible score 24 and a non-frangible hinge segment 26. The hinge segment 26 is defined by a generally straight line between a first end and a second end 30 of the frangible score 24. The tear panel 22 of the center panel 18 may be opened, that is the frangible score 24 may be severed and the tear panel 22 displaced at an angular orientation relative to the remaining portion of the center panel 18, while the tear panel 22 remains hingedly connected to the center panel 18 through the hinge segment 26. In this opening operation, the tear panel 22 is displaced at an angular deflection, as it is opened by being displaced away from the plane of the panel 18.

The frangible score 24 is preferably a generally V-shaped groove formed into the public side 32 of the center panel 18. A residual is formed between the V-shaped groove and the product side 34 of the end member 10.

The end member 10 has a tab 28 secured to the center panel 18 adjacent the tear panel 22 by a rivet 38. The rivet 38 is formed in the typical manner.

During opening of the end member 10 by the user, the user lifts a lift end 40 of the tab 28 to displace a nose portion 42 downward against the tear panel 22. The force of the nose portion 42 against the tear panel 22 causes the score 24 to fracture. As the tab 28 displacement is continued, the fracture of the score 24 propagates around the tear panel 22, preferably in progression from the first end of the score 24 toward the second end 30 of the score 24.

Figure 2:
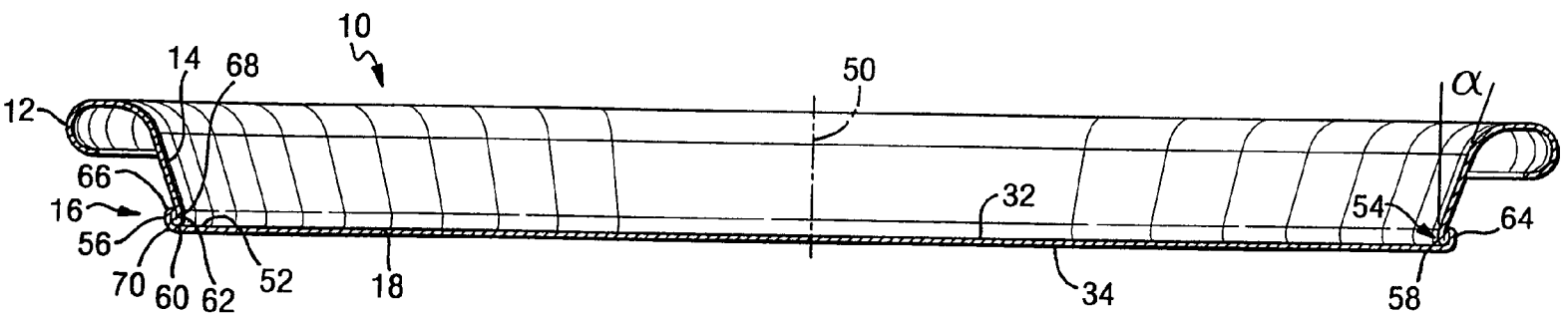
FIG. 2 is a partial cross-sectional view of a can end member of the present invention.

Now referring to FIG. 2, the center panel 18 is centered about a longitudinal axis 50 which is perpendicular to a diameter of the center panel 18. The seaming curl 12 defines an outer perimeter of the end member 10 and is integral with the chuck wall 14. The chuck wall 14 extends downwardly from the seaming curl 12 at an obtuse angle. A chuck wall angle $\alpha$ measured from a planar or substantially planar peripheral edge portion 52 of the center panel 18 is generally between 10 and 70 degrees, more preferably between 15 and 45 degrees, and most preferably 19 to 27 degrees, or any range or combination of ranges therein. The chuck wall 14 may be provided with a radius of curvature as shown in the drawings to improve performance within the forming tools used to form the end member 10. The radius of curvature helps prevent buckling within the tools as force is applied to the unfinished end member 10.

The transition wall 16 is integral with the chuck wall 14 and connects the chuck wall 14 the to the peripheral edge portion 52 of the center panel 18. The end member 10 differs from contemporary beverage can end members that typically include a countersink formed in the outer peripheral edge of the center panel 18. The planar peripheral edge portion 52 allows the tear panel 24 to be placed closer to the outer perimeter of the end member 10. It also provides additional center panel 18 area for printing and/or a larger tear panel opening.

The transition wall 16 includes a fold 54 extending outwardly relative to the longitudinal axis 50. The drawings show the fold 54 formed along an exterior portion of the chuck wall 14; however, it should be understood that the fold 54 can be located in other locations such as along the product side 34 of the center panel 18. However, the fold 54 preferably extends upwardly at an angle $\lambda$ of about 8° above a horizontal plane. (See FIGS. 65 and 66).

The fold 54 has a first leg 56 connecting the chuck wall 14 to an annular concave bend or portion 58. The annular concave portion 58 includes an apex 60 which approaches so as to preferably engage the outer peripheral edge 52 of the center panel 18. This contact between the apex 60 and the outer peripheral edge 52 helps to prevent dirt from accumulating along the peripheral edge 52 of the center panel 18. It also allows the center panel 18 to be easily cleaned when dirt or other residue is present on the center panel 18.

A second leg 62 extends upwardly from the annular concave portion 58 to an annular convex bend or portion 64. The second leg 62 can be vertical, substantially vertical, or up to ±25 degrees to the longitudinal axis 50 and can be pressed against an outer portion of the first leg 56.

The annular convex portion 64 includes an apex 66 which defines a vertical extent of the fold 54. A length of the fold 54 is substantially less than a length of the seaming curl 12. In combination with, inter alia, the angled chuck wall 14, this fold 54 structure and length allows the buckling strength of the end member 10 to meet customer requirements while decreasing the size of the cut edge blank and maintaining the diameter of the finished end. In other words, a smaller cut edge blank can be provided to produce the same sized diameter end member as a larger cut edge blank formed in the conventional manner with a countersink.

A third leg 68 extends downwardly from the annular convex portion 64 to a third bend 70 which joins the transition wall 16 to the outer peripheral edge 52 of the center panel 18. The third bend 70 has a radius of curvature which is suitable for connecting the third leg 68 to the planar outer peripheral edge of the center panel 18.

The third leg 68 can be pressed against an outer portion of the second leg 62. This gives the fold 54 a transverse thickness which is substantially equal to three times the thickness of the thickness of the chuck wall 14, and the transverse thickness of the fold 54 is substantially less than the length of the chuck wall 14. Again, this structure results in a metal savings by allowing the cut edge blank to be smaller than conventional cut edge blanks used to make the same diameter end member. For example, the average diameter of a cut edge blank used to form a standard 202 can end is approximately 2.84 ins. (72.14 mm) while the average diameter of a cut edge blank used to form a 202 can end of the present invention is approximately 2.70 ins. (68.58 mm).

The end member 10 can be formed in a shell press, a conversion press, or a combination of both. For example, the end member 10 can be partially formed in the shell press and then completed in the conversion press. The end member 10 can also be finished in an alternate forming machine, such as a roll forming apparatus. Alternatively, the end member 10 can be all or partially roll formed before or after the conversion press.

FIGS. 3-13 illustrate numerous embodiments of the can end 10 of the present invention. These embodiments include several design variations aimed improving the strength, stacking, performance, and or cleanliness of the can ends 10.

Figure 3:
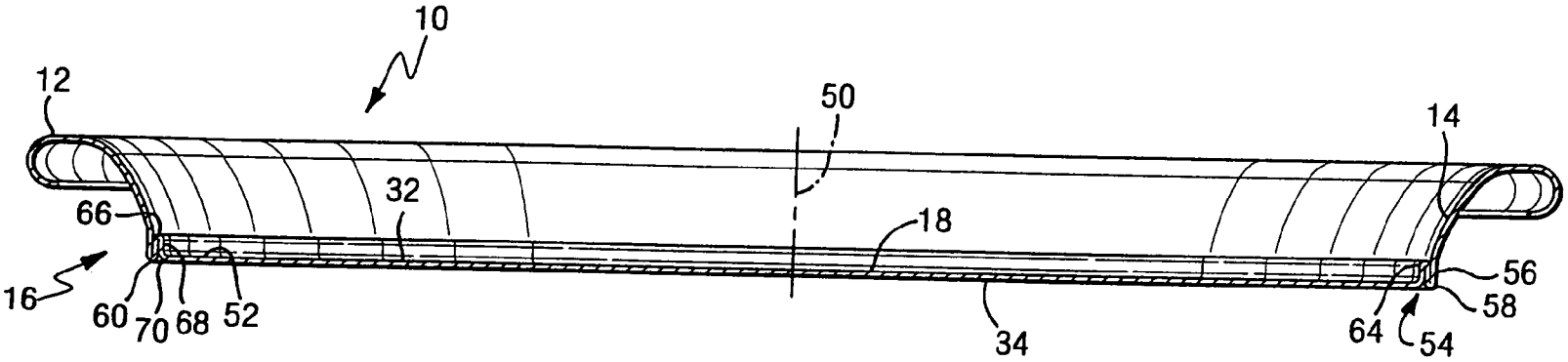
FIG. 3 is a partial cross-sectional view of a can end of the present invention.

FIG. 3 illustrates an alternative embodiment of the can end 10 of the present invention. In this embodiment, the fold 54 extends inwardly relative to the longitudinal axis 50. The annular concave portion 58 does not contact the peripheral edge 52.

Figure 4:
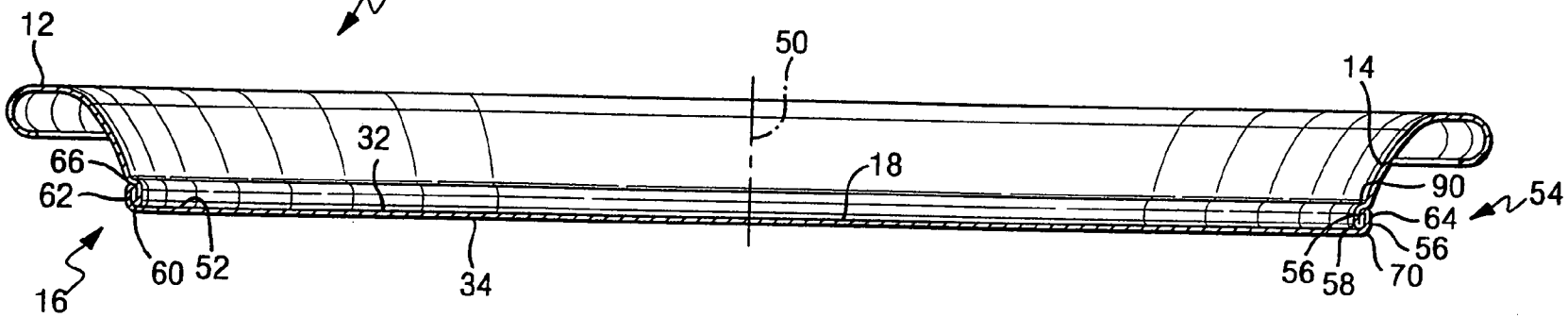
FIG. 4 is a partial cross-sectional view of a can end of the present invention.

FIG. 4 illustrates another embodiment of the can end 10 of the present invention. In this embodiment, the chuck wall 14 includes an outwardly extending step 90 for increased strength. The step 90 bends outwardly against the annular convex portion 64. In this embodiment, the outer portion of the step engages vertical extent of the annular convex portion 64.

Figure 5:
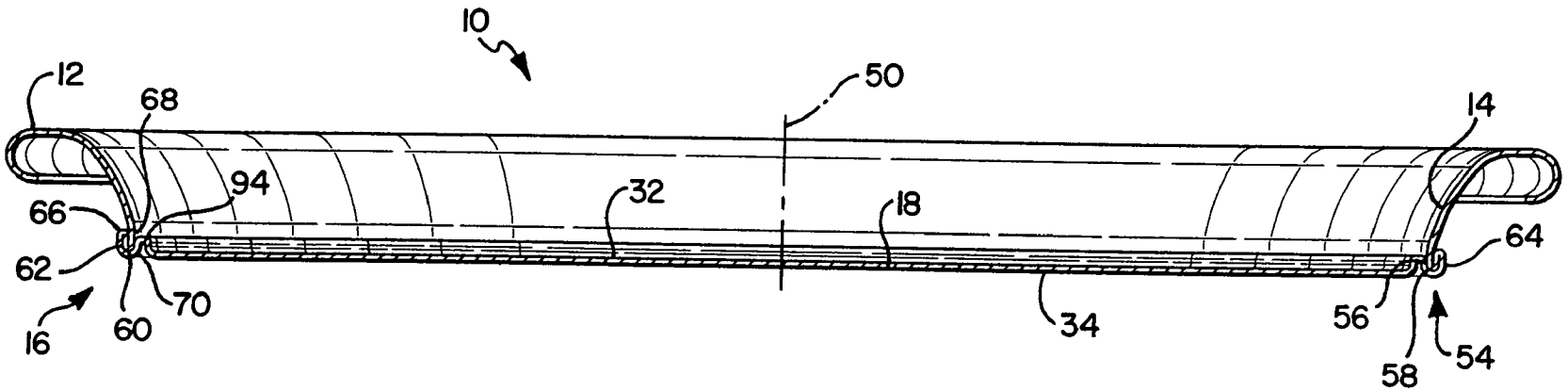
FIG. 5 is a partial cross-sectional view of a can end of the present invention.

FIG. 5 illustrates another embodiment of the can end 10 of the present invention. In this embodiment, the center panel 18 includes an upwardly projecting rib 94. The rib 94 is located along the peripheral edge of the center panel 18.

Figure 6:
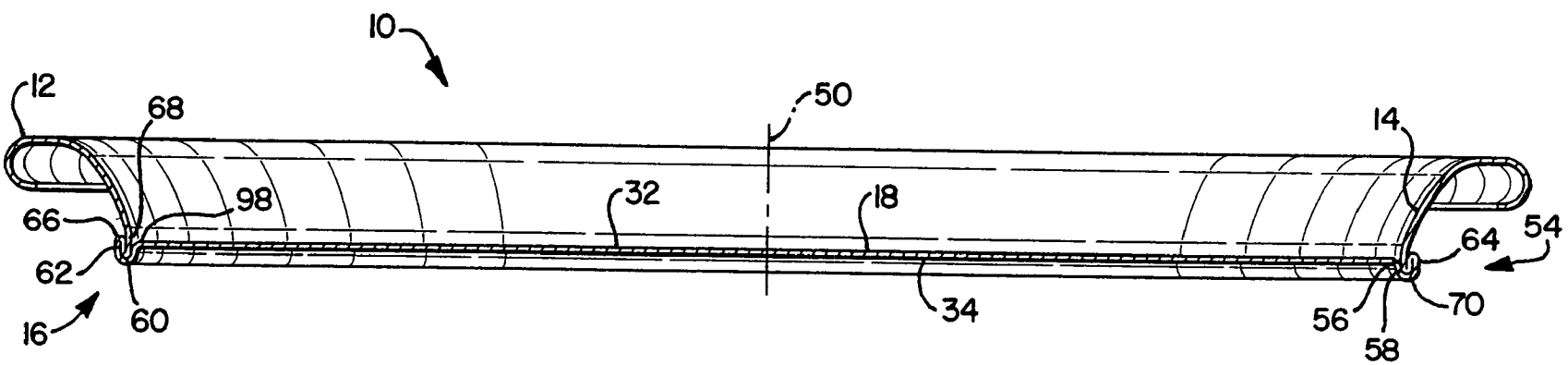
FIG. 6 is a partial cross-sectional view of a can end of the present invention.

FIG. 6 illustrates another embodiment of the can end 10 of the present invention. In this embodiment, the center panel 18 includes an increased height. Accordingly, the center panel 18 includes an upward step 98 at its peripheral edge.

Figure 7:
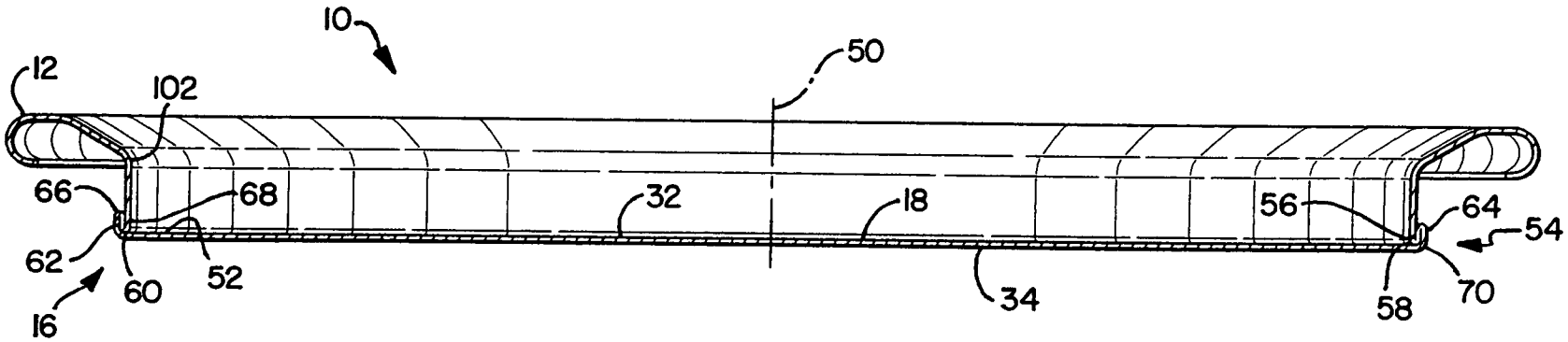
FIG. 7 is a partial cross-sectional view of a can end of the present invention.

FIG. 7 illustrates another embodiment of the can end 10 of the present invention. In this embodiment, the chuck wall 14 includes a bend or kink 102. The kink 102 is directed outwardly relative to the longitudinal axis 50.

Figure 8:
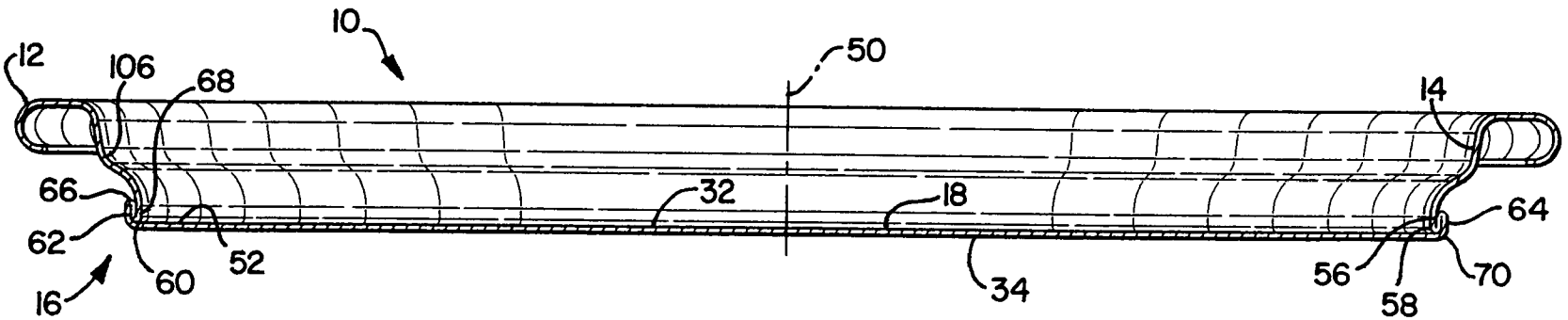
FIG. 8 is a partial cross-sectional view of a can end of the present invention.

FIG. 8 illustrates another embodiment of the can end 10 of the present invention. In this embodiment, the chuck wall 14 includes a stepped-profile 106. The stepped-profile 106 has an upwardly and outwardly directed convex annular portion integral with an upwardly annular concave portion which is interconnected with the seaming curl 12.

Figure 9:
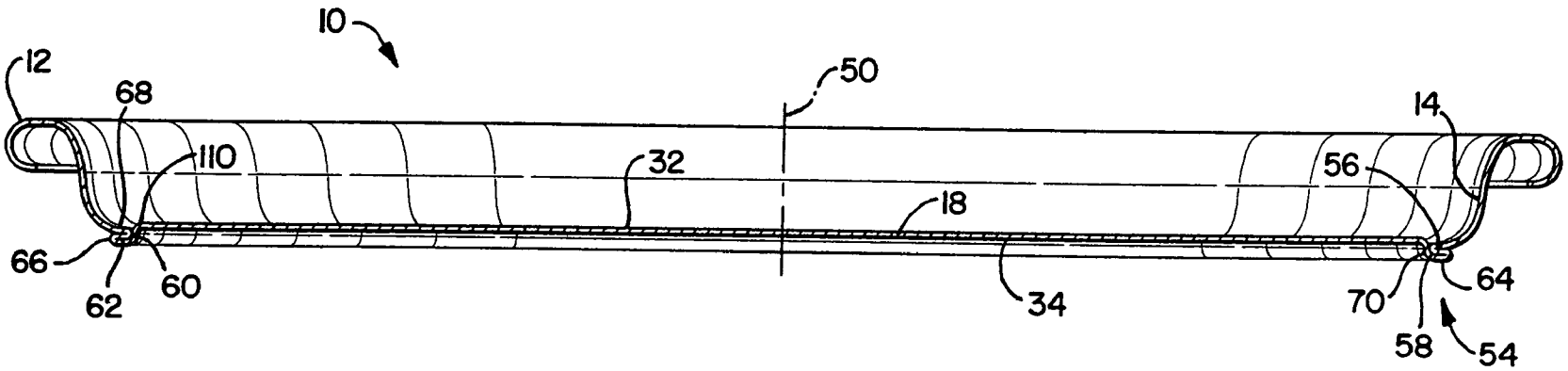
FIG. 9 is a partial cross-sectional view of a can end of the present invention.

FIG. 9 illustrates another embodiment of the can end 10 of the present invention. In this embodiment, the fold 54 is located in a plane which is approximately perpendicular to the longitudinal axis 50. Further, the center panel 18 includes an increased height by step 110. The increased height of the center panel 18 brings the center panel 18 at least approximately in a common horizontal plane, perpendicular to the longitudinal axis, with a portion of the first leg 56 of the fold 54. The increased height of the center panel 18 may also bring the center panel 18 into a horizontal plane which lies just above or below a portion of the first leg 56.

Figure 10:
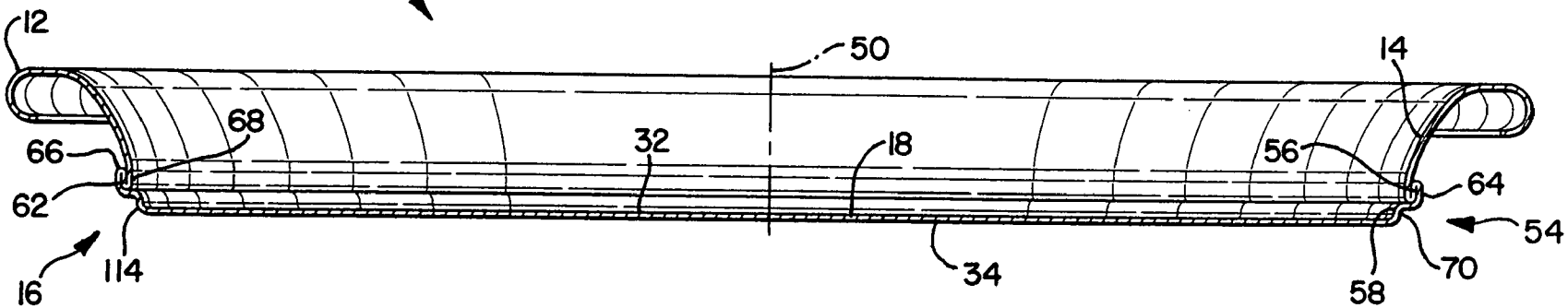
FIG. 10 is a partial cross-sectional view of a can end of the present invention.

FIG. 10 illustrates another embodiment of the can end 10 of the present invention. In this embodiment, the center panel 18 includes a stepped-profile 114 along its peripheral edge. The stepped-profile 114 has an upwardly directed concave annular portion integral with an upwardly annular convex portion which is interconnected with the fold 54.

Figure 11:
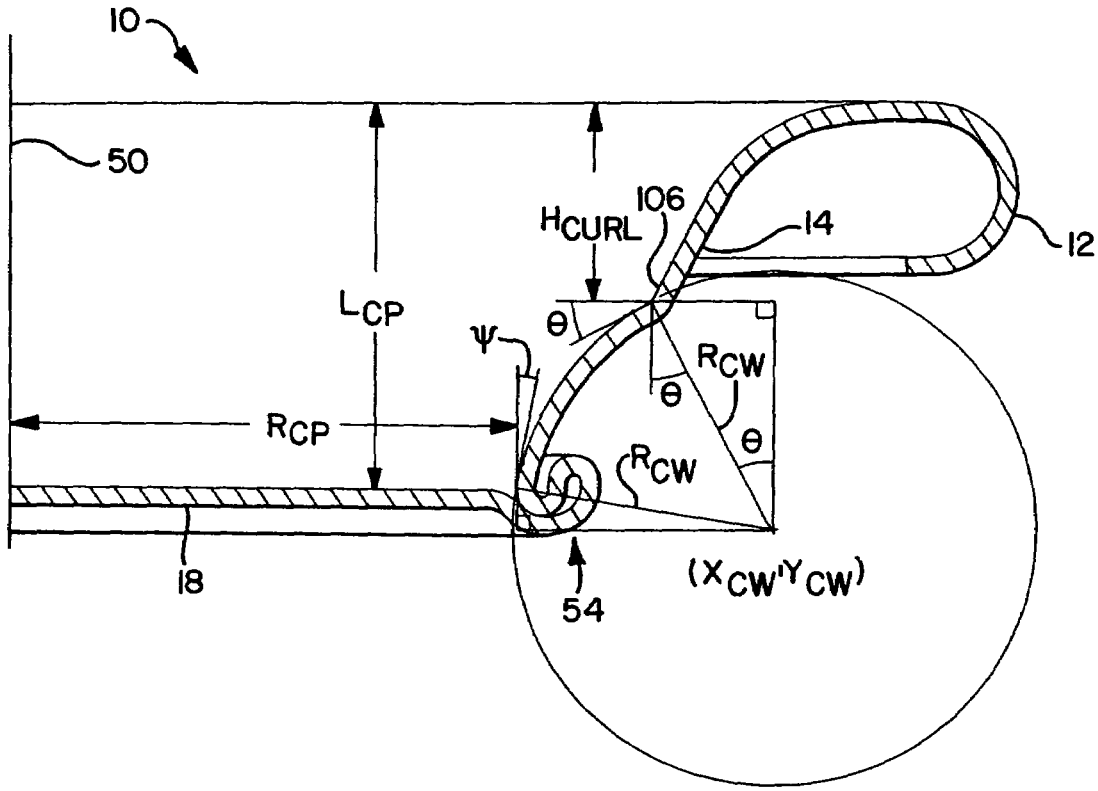
FIG. 11 is a partial cross-sectional view of a can end of the present invention.

Referring to FIG. 11, another embodiment of the end member 10 of the present invention is illustrated. In this embodiment, the chuck wall 14 includes a stepped-profile 106 similar to FIG. 8. Again, the stepped-profile 106 has an upwardly and outwardly directed convex annular portion integral with an upwardly annular concave portion which is interconnected with the seaming curl 12. A lower portion of the chuck wall 14, or connecting wall, includes a radius of curvature $R_{CW}$, and is angled outwardly at an angle ψ from a line parallel to the longitudinal axis 50. This lower portion of the chuck wall is angled about 35 degrees from an upper portion beginning at a bend to the transition wall 16. The radius of curvature $R_{CW}$ is chosen in combination with the center panel depth $L_{CP}$, i.e. the distance from the upper extent of the seaming curl 14 to the center panel 18, the center panel radius $R_{CP}$ (measured from a center point at the longitudinal axis to the chuck wall), and the curl height $H_{curl}$, i.e. the distance from the upper extent of the seaming curl 12 to the intersection of the convex annular portion the upwardly annular concave portion, to arrive at a suitable 202 end member having a diameter of 2.33 ins. to 2.35 ins. (59.18 mm to 59.69 mm).

The chuck wall 14 panel depth can be expressed in terms of the following relationships:

$$X_{CW}=R_{CP}+R_{CW}\cos\psi;$$

$$Y_{CW}=R_{CW}\sin\psi;$$

$$L_{CP}=H_{curl}+R_{CW}(\cos\theta+\sin\psi);$$

$$R_{CW}^2=Y_{CW}^2+(X_{CW}-R_{CP})^2;\text{ and}$$

$$L_{CP}=H_{curl}+\{[Y_{CW}^2+(X_{CW}-R_{CP})^2]^{1/2}*(\cos\theta+\sin\psi)\};$$

where $X_{CW}$ is the center of the arc of curvature of the lower portion of the chuck wall 14, measured as a horizontal distance from the longitudinal axis 50; $Y_{CW}$ is the center of the arc of curvature of the lower portion of the chuck wall 14, measured as a vertical distance above or below the center panel 18; and the angle θ is the angle measured between a line perpendicular to the longitudinal axis 50 and an uppermost segment of the lower portion of the chuck wall 14.

The center panel depth $L_{CP}$ ranges from 0.160 ins. to 0.250 ins. (4.064 mm to 6.350 mm), more preferably 0.180 ins. to 0.240 ins. (4.572 mm to 6.096 mm), or any range or combination of ranges therein. The center panel diameter, double the value of $R_{CP}$, ranges from 1.380 ins. to 1.938 ins. (35.052 mm to 49.225 mm), more preferably 1.830 ins. to 1.880 ins. (46.482 mm to 47.752 mm), or any range or combination of ranges therein. The radius of curvature $R_{CW}$ varies accordingly to arrive at a 202 end member 10, but is typically 0.070 ins. to 0.205 ins. (1.778 mm to 5.207 mm), but can be any value less than infinite. In other words, assuming a fixed center panel height, as the center panel diameter increases the radius of curvature $R_{CW}$ increases. The following table illustrates this relationship.

TABLE 1

| Center Panel Height | Center Panel Diameter | Radius of Curvature ($R_c$) |
|---|---|---|
| 0.180 ins. | 1.831 ins. | 0.0854 ins. |
| 0.180 | 1.855 | 0.0863 |
| 0.180 | 1.878 | 0.0898 |
| 0.210 | 1.831 | 0.1123 |
| 0.210 | 1.855 | 0.1272 |
| 0.210 | 1.878 | 0.1385 |
| 0.240 | 1.831 | 0.1665 |
| 0.240 | 1.855 | 0.1803 |
| 0.240 | 1.878 | 0.2016 |

Figure 12:
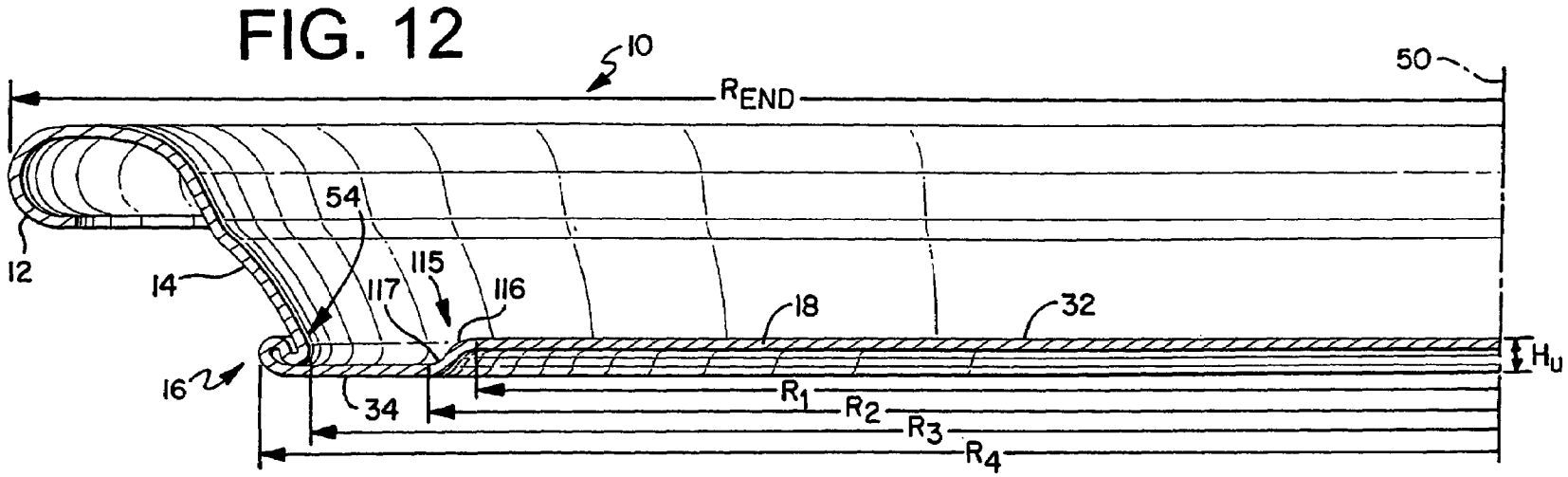
FIG. 12 is a partial cross-sectional view of a can end of the present invention.
Figure 13:
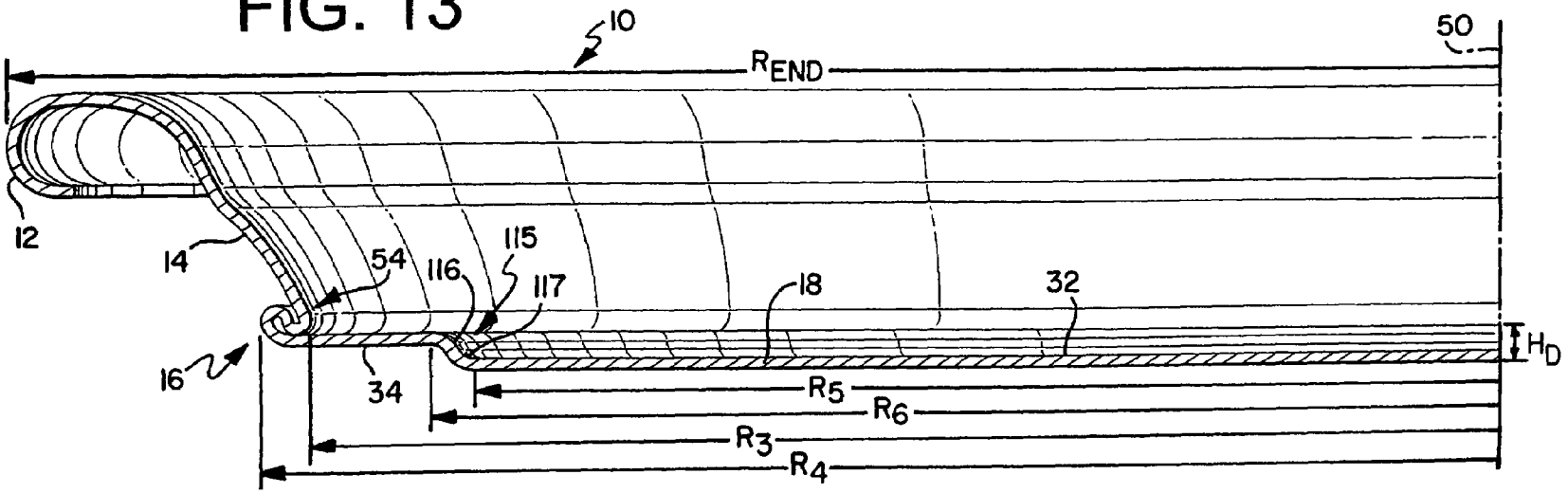
FIG. 13 is a partial cross-sectional view of a can end of the present invention.
Figure 14:
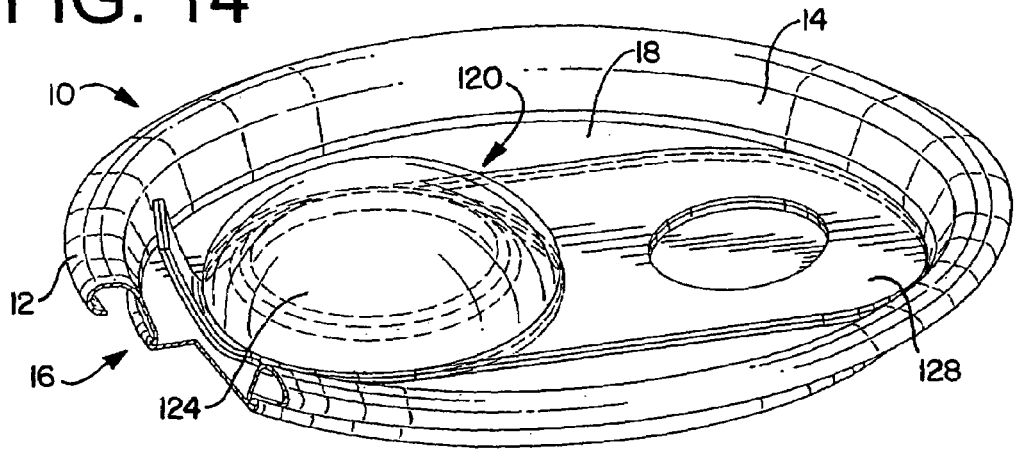
FIG. 14 is a perspective view of an embodiment of the including a peelably bonded closure.

FIGS. 12 and 13 illustrate an alternative embodiment of the can end member 10 of FIG. 11. These embodiments include a circumferential step portion, a partially circumferential step portion, or a plurality of partially circumferential step portions 115 located radially outwardly from the longitudinal axis 50. The step portion 115 has an annular convex portion 116 joined to an annular concave portion 117 and displaces at least a portion of center panel 18 vertically in a direction parallel to the longitudinal axis 50. Portions of the annular convex 116 and concave portion 117 may be coined during forming to promote strength and to displace metal toward the fold 54 to inhibit a pulling force on the fold 54 which could cause the fold 54 to open or unfold. Coining is the work hardening of metal between tools. The metal is typically compressed between a pair of tools, generally an upper and lower tool.

The end member 10 can also exhibit multiple steps either upwardly or downwardly.

Referring specifically to FIG. 12, the end member 10 is shown without a closure member and/or tab for clarity purposes. In this embodiment, the end member 10 further comprises a center panel 18 wherein the step 115 has an upward orientation of a height $H_U$ of about 0.02 ins. (0.51 mm). The upwardly oriented step 115 increases the buckle strength characteristic of the end member 10. Buckle strength improves as the step 115 is located radially inwardly of the fold 54. However, as the radial distance between the fold 54 and the step 115 increases, the area of the center panel 18 that is available for informative lettering decreases. Therefore, these relationships must be optimized to allow for a sufficient area for printed information while maintaining sufficient buckle strength.

The upwardly oriented step 115 has a convex annular radially innermost portion 116 joined to a concave annular radially outermost portion 117. The innermost portion 116 has a radius of curvature of about 0.015 ins. (0.381 mm). The outermost portion 117 has a radius of curvature of about 0.020 ins. (0.51 mm). The radially innermost portion 116 of the step 115 is located a distance $R_1$ of about 0.804 ins. (20.422 mm) from the center of the end member 10. The radially outermost portion of the step 115 is located a distance $R_2$ of about 0.8377 ins. to 0.843 ins. (21.2776 mm to 21.4122 mm) from the center of the end member 10. The fold 54 of this embodiment has a radially inner most portion located at a distance $R_3$ of about 0.9338 ins. to 0.94 ins. (23.7185 mm to 23.876) from the center of the end member 10, and a radially outermost portion located at a distance $R_4$ of about 0.9726 ins. to 0.98 ins. (24.7040 mm to 24.892 mm) from the center of the end member 10. The end member 10 has a radius $R_{end}$ of about 1.167 ins. to 1.17 ins. (29.642 mm to 29.78 mm).

These dimensions are directed to a 202 end member. One of ordinary skill in the art would recognize that these principles could be applied to an end member of any diameter. For example, in a 200 end member, $R_1$ would be about 0.7725 ins. (19.6215 mm); $R_3$ would be about 0.906 ins. (23.0124 mm); $R_4$ would be about 0.951 ins. (24.1554 mm); and other dimensions would decrease as well, preferably proportionally. Further in a 209 end member, $R_1$ would be about 0.8275 ins. (21.0185 mm); $R_3$ would be about 0.972 ins. (24.6888 mm); $R_4$ would be about 1.0220 ins. (25.9588 mm); and other dimensions would increase as well, preferably proportionally.

FIG. 13 illustrates an another embodiment of the can end member 10 of FIG. 11. Again, the end member 10 is shown without a closure member and/or tab for clarity purposes. In this embodiment, the end member 10 further comprises a center panel 18 wherein the step 115 has a downward orientation having a depth $H_D$ of about 0.02 ins. (0.51 mm). The downwardly oriented step 115 increases the buckle strength characteristic of the end member 10. Buckle strength improves as the step 115 is located radially inwardly of the fold 54. However, as the radial distance between the fold 54 and the step 115 increases, the area of the center panel 18 that is available for lettering decreases. Therefore, these relationships must be optimized to allow for a sufficient area for printed information while maintaining sufficient buckle strength.

The downwardly oriented step 115 has a concave annular radially innermost portion 117 joined to a convex annular radially outermost portion 116. These annular portions have radii of curvature of about 0.015 ins. (0.381 mm), and may be coined during forming to prevent the fold 54 from adverse deformation. The radially innermost portion of the step 115 is located a distance $R_5$ of about 0.804 ins. (20.422 mm) from the center of the end member 10. The radially outermost portion of the step 115 is located a distance $R_6$ of about 0.8377 ins. (21.2776 mm) from the center of the end member 10. The fold 54 of this embodiment has a radially inner most portion located at a distance $R_3$ of about 0.9338 ins. (23.7185 mm) from the center of the end member 10, and a radially outermost portion located at a distance $R_4$ of about 0.9726 ins. (24.7040 mm) from the center of the end member 10. The end member 10 has a radius $R_{end}$ of about 1.167 ins. (29.642 mm).

Again, these dimensions are directed to a 202 end member. One of ordinary skill in the art would recognize that these principles could be applied to an end member of any diameter. The dimensions would increase or decrease depending on the relative size of the end member, preferably proportionally.

Now referring to FIGS. 14-26, further embodiments of the present invention are illustrated. In these embodiments, the can end 10 includes a peelably bonded closure. These types of closures are described in PCT International Publication Number WO 02/00512 A1. One ordinary skilled in the art would understand that any of the closures shown in FIGS. 2-13 can be used in combination with the embodiments illustrated in FIGS. 14-26.

The can ends 10 of the embodiments illustrated in FIGS. 14-26 generally include a seaming curl 12, a chuck wall 14, a transition wall 16, and a center panel 18. The center panel 18 includes a flange area 120 defining an aperture 124. A closure member 128, such as a flexible metal foil closure, extends over the aperture 124 and is peelably bonded by a heat seal to a portion of the flange 120. The can ends of these embodiments do not require the formation of a rivet.

The flange 120 is typically an upwardly projecting frustoconical annular surface 132 formed in the center panel 18. It is contemplated that this configuration achieves adequate burst resistance without requiring excessive force to peel the closure member 128.

The frustoconical annular surface 132 defines the shape of the aperture 124. The aperture 124 is preferably a circular shape, but it should be understood that the aperture 124 can be any shape without departing from the spirit of the invention.

Figure 24:
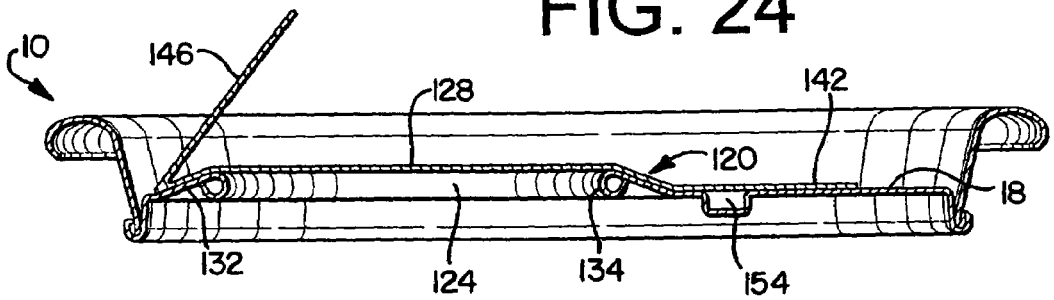
FIG. 24 is a partial cross-sectional view of an embodiment of the can end of the present invention having a peelably bonded closure and a fragrance concentrate reservoir.

A peripheral edge of the frustoconical annular surface 132 is generally formed as a bead 134. The bead 134 protects a drinker's lips from touching and being injured by the cut metal of the peripheral edge of the frustoconical annular surface 132, and avoids damaging the closure member 128 by contact with the cut metal. The bead 134 may have a reverse curl as shown, e.g., in FIG. 15, or a forward curl as shown in FIG. 24. In either case, a horizontal plane P is tangent to an upper extent of the bead 134.

The reverse curl is the preferred method of forming the bead 134. Once the closure member 128 is heat-sealed to the flange 120 surface, the cut metal (typically an aluminum alloy) at the peripheral edge of the frustoconical annular surface 132 must not come into contact with the contained beverage because the cut metal at the edge (unlike the major surfaces of the can end 10) has no protective coating, and would be attacked by acidic or salt-containing beverages. Alternatively, the cut edge may be protected by application of a lacquer to the peripheral edge of the frustoconical annular surface 132.

The flexible closure member 128 is produced from a sheet material comprising metal foil, e.g. aluminum foil, preferably a suitably lacquered aluminum foil sheet or an aluminum foil-polymer laminate sheet. Stated more broadly, materials that may be used for the closure member 128 include, without limitation, lacquer coated foil (where the lacquer is a suitable heat seal formulation); extrusion coated foil (where the polymer is applied by a standard or other extrusion coating process); the aforementioned foil-polymer laminate, wherein the foil is laminated to a polymer film using an adhesive tie layer; and foil-paper-lacquer combinations such as have been used for some low-cost packaging applications.

The closure member 128 extends entirely over the aperture 124 and is secured to the frustoconical annular surface 132 by a heat seal extending at least throughout the area of an annulus entirely surrounding the aperture 124. Since the reverse curl bead 134 does not project beyond the slope of the flange 120 outer surface, the closure member 128 smoothly overlies this bead 134 as well as the flange 120 outer surface, affording good sealing contact between the closure member 128 and the flange 120. The closure member 128 is bonded by heat sealing to the flange 120, covering and closing the aperture 124, before the can end 10 is secured to a can body that is filled with a carbonated beverage.

Once the can end 10 has been attached to the can body, a force applied by a beverage generated pressure causes the flexible closure member 128 to bulge outwardly. An angle $\sigma$ of the slope of the flange 120 outer surface relative to the plane P of the peripheral edge of the frustoconical annular surface 132 (see FIG. 15) is selected to be such that a line tangent to the arc of curvature of the bulged closure member 128 at the inner edge of the flange 120 lies at an angle to plane P not substantially greater than an angle a of the slope of the flange 120 outer surface. Since the public side 32 of the can end 10 is substantially planar (and thus parallel to plane P), the angle a may alternatively be defined as the angle of slope of the flange 120 outer surface to the public side 32 surface (at least in an area surrounding the flange 120).

Figure 15:
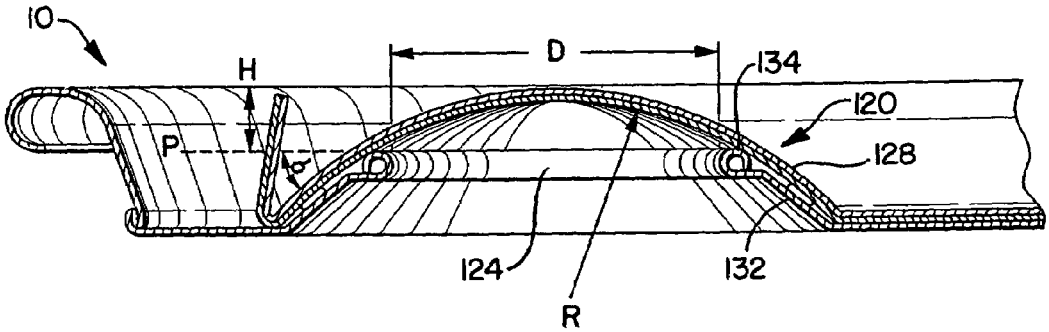
FIG. 15 is a partial cross-sectional view of an embodiment of the can end of the present invention having a peelably bonded closure.
Figure 16:
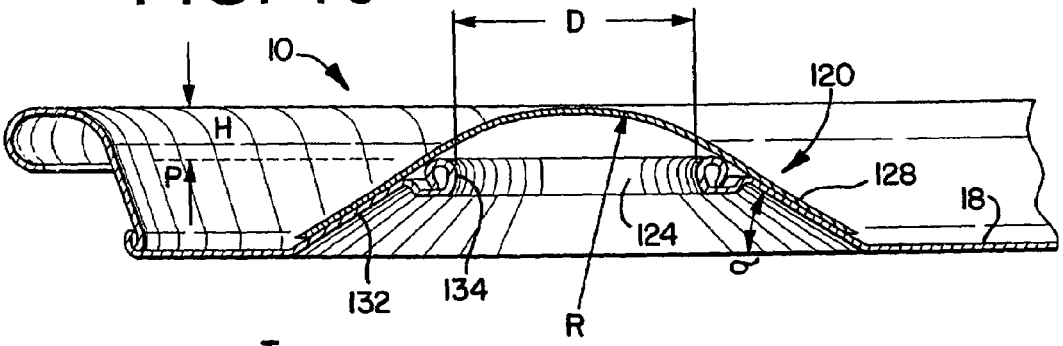
FIG. 16 is a partial cross-sectional view of an embodiment of the can end of the present invention having a peelably bonded closure.
Figure 17:
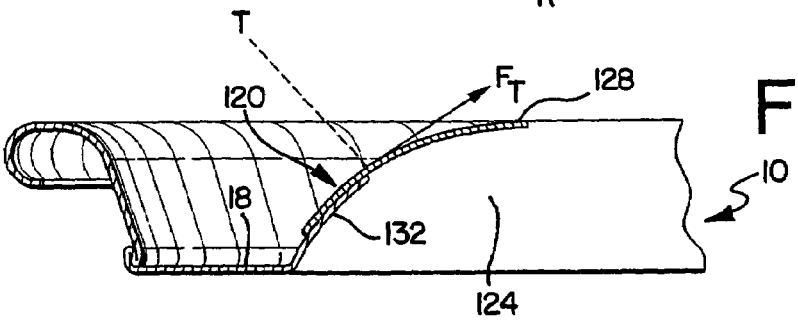
FIG. 17 is a partial cross-sectional view of an embodiment of the can end of the present invention having a peelably bonded closure.
Figure 22:
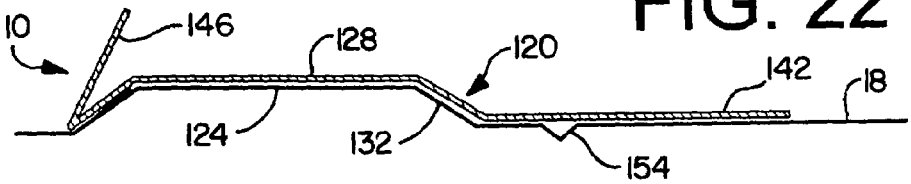
FIG. 22 is a partial cross-sectional view of an embodiment of the can end of the present invention having a peelably bonded closure and a fragrance concentrate reservoir.
Figure 23:
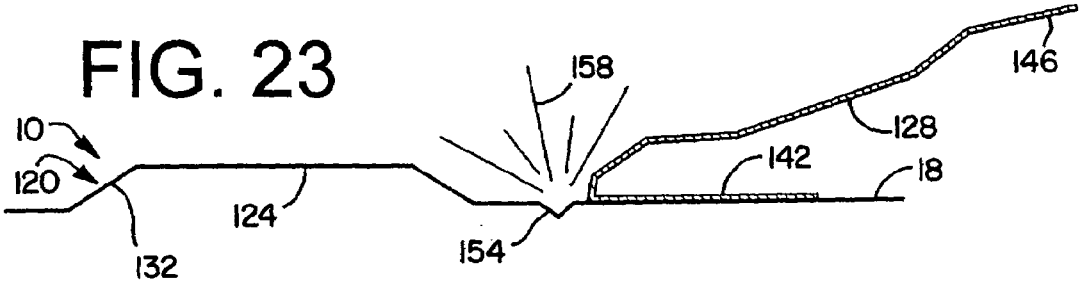
FIG. 23 is a partial cross-sectional view of an embodiment of the can end of the present invention having a peelably bonded closure and a fragrance concentrate reservoir.

In FIGS. 15 and 16, the closure member 128 is shown domed to the point at which the frustoconical annular surface 132 is tangential to the arc of the domed closure member 128. In other words, the line of slope of the frustoconical annular surface 132 as seen in a vertical plane is tangent to the arc of curvature of the closure member 128 (as seen in the same vertical plane) at the peripheral edge of the aperture 124.

For these closures, the forces $F_T$ acting on the heat sealed flange area 120 due to the tension in the foil are primarily shear forces, with no significant peel force component acting in the direction T at 90° to the plane of the frustoconical annular surface 132. Thus, the burst resistance will depend on the shear strength of the heat seal joint or the bulge strength of the foil or foil laminate itself. This provides greater burst resistance relative to standard heat sealed containers which are generally planar.

The frustoconical annular surface 132 provides the slope angle $\sigma$ which is sufficient to accommodate the extent of doming or bulging of the closure member 128 under the elevated internal pressures for which the can is designed, and thereby enables the burst resistance to be enhanced significantly, for a closure 128 with a peel force which is acceptable to the consumer. The angle a is between about 12.5° and about 30° to the plane P, and more preferably at least 15°, and most preferably between about 18° and about 25°, or any range or combination of ranges therein. The peel force is dependent both on the inherent properties of the selected heat seal lacquer system, and on geometric effects associated with the complex bending and distortion which the closure member 128 undergoes during peeling.

The circular aperture 124 generally has a diameter D of 0.787 ins. (20.0 mm). The aperture 124 is defined by the frustoconical annular surface 132 of the flange 120 which generally has a maximum diameter (in the plane of center panel 18) of 1.181 ins. (30.0 mm). Referring to FIG. 18, the closure member 128 has a circular center portion 138 that large is enough to completely overlie the sloping outer surface of the flange 120, i.e. about 1.260 ins. (32.0 mm). The closure member 128 includes a short projection 142 on one side for overlying a part of the center panel 18 and an integral tab portion 146 on the opposite side that is not heat sealed but is free to be bent and pulled.

The closure member stock may be a suitable deformable material such as an aluminum foil (e.g. made of alloy AA3104 or of a conventional foil alloy such as AA3003, 8011, 8111, 1100, 1200) with a thickness of 0.002 ins. to 0.004 ins. (50.8 μm to 101.6 μm) which is either lacquered on one side with a suitable heat sealable lacquer, or laminated on one side with a suitable heat sealable polymer film (e.g., polyethylene, polypropylene, etc.), 0.001 ins. to 0.002 ins. (25.4 μm to 50.8 μm) thick. The public side should have a suitable protective lacquer coating. It may be desirable to print onto the foil using known printing methods. It may also be desirable to emboss the laminate to make the closure easier to grip.

The closure member 120 and heat seal must be designed to withstand the force provided by the pressurized contents of a container. Therefore, the closure member 120 must be bonded to withstand tear/shear force resistance that range from 25 lb/in (0.45 kg/mm) to 75 lb/in. (1.34 kg/mm), or any range or combination of ranges therein.

When applied to the can end 10, the portion of the closure member 120 that extends across the aperture 124 may be substantially planar as illustrated in FIG. 19. When the can end 10 is mounted on a container that is filled with a carbonated beverage, the pressure given off by the carbonation causes closure member 128 to bulge upwardly wherein the closure member exhibits a radius of curvature R and a height H above plane P.

Referring to FIG. 21 a stay-on or retainable closure member 128 is illustrated. The closure member 128 includes an annular center portion 138 that is bonded to the frustoconical annular surface 142 of the flange 120. At the side of the aperture 124 adjacent the peripheral edge of the center panel 18, the closure member 128 has an integrally formed pull tab 146. The closure member 128 also has an integral "stay-on" extension 142 opposite the tab 146 and overlying a portion of the center panel 18. The extension 142 is bonded to the can end 10 by a further heat seal portion which is dimensioned to require a substantially greater peeling force (for separating extension 142 from the can end 10) than that required by the annular center portion 138 (for separating the closure member 128 from the angled flange 120 around the aperture 124).

The extension 142 is sealed to the can end 10 by the portion of the heat seal that has a size and shape which requires a substantially higher peel force (greater resistance to peeling) than the annular center portion 138 surrounding the aperture 124. This discourages a consumer from completely removing the closure foil 128. As a result of this design, when the consumer opens the closure 128, the peel will initially be within the targeted range for each opening, e.g. from about 1.8 lb. to 4.5 lb. (8 N to 20 N). Then as the aperture 124 is completely opened, the peel force will fall to a very low value so that the consumer will sense that the opening is completed.

If the consumer continues to pull the closure, the required peel force will rise rapidly to a value which exceeds the normally accepted easy peel range, i.e. to >5.5 lb. (24.5 N).

Another embodiment of the present invention is illustrated in FIGS. 22-26. This embodiment incorporates a fragrance or aroma reservoir 154 that carries an oil or wax based aroma concentrate 158. The concentrate 158 is released when the closure member 128 is peeled back. The aroma is selected to enhance or complement the taste of the beverage.

The reservoir 154, and hence the supply of fragrance 158, are disposed on the side of the aperture 124 away from the peripheral edge of the center panel 18 so as to be close to the user's nose. This location is between the aperture 124 and the stay-on heat seal portion and is thus covered by the closure extension 142 when the closure member 128 is sealed on the can end.

Figure 25:
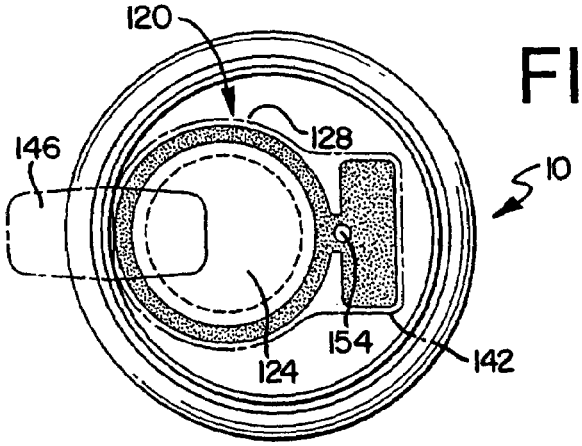
FIG. 25 is a top plan view of a container having a peelable closure and a fragrance concentrate reservoir.
Figure 26:
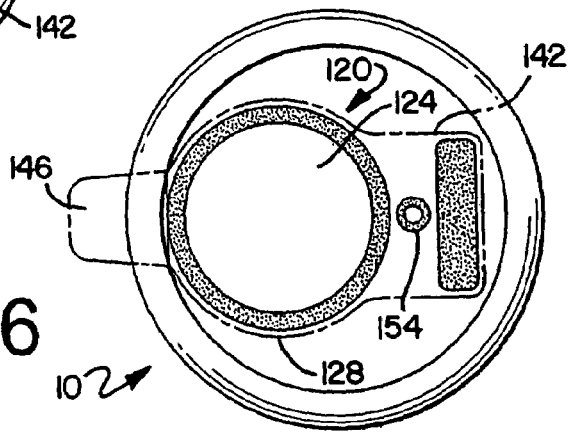
FIG. 26 is a top plan view of a container having a peelable closure and a fragrance concentrate reservoir.

In this embodiment, the closure member 128 is configured to fully surround the reservoir 154 containing the concentrate 158. Two specific heat seal designs for this purpose are respectively shown in FIGS. 25 and 26. In FIG. 25, the heat seal area around the aperture 124 is contiguous with the heat seal area surrounding the fragrance reservoir 154 and the heat seal portion that secures the extension 142 to the can end 10. When the closure 128 is peeled back, the fragrance-containing reservoir 154 will be partially or fully exposed and the concentrate 158 will be released. In FIG. 26, the heat seal area surrounding the reservoir 154 is isolated from the heat seal portions around the aperture 124 and at the extension 142. This method reduces likelihood that the concentrate 158 will evaporate as a result the heat input from the heat sealing tools.

FIGS. 27-32 and FIGS. 33-37, illustrate one method for forming an end member 10 of the present invention. FIGS. 27-32 show the progression of the end member 10 from a shell to the finished end 10 without the tooling. FIGS. 33-37 show the tooling contemplated for forming the end member 10. The method shows the fold 54 formed from a lower segment of the chuck wall 14 referred to as the transition wall 16 herein. However, it should be understood that the transition wall 16 can be formed from a portion of the peripheral edge 52 of the center panel 18 without departing from the spirit of the invention.

Figure 27:
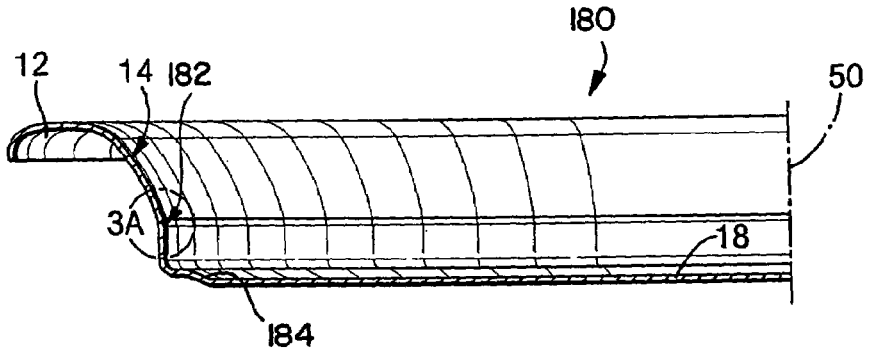
FIG. 27-32 are partial cross-sectional views of a can end member of the present invention shown in forming stages.
Figure 27A:
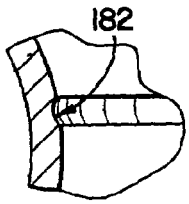
Figure 28:
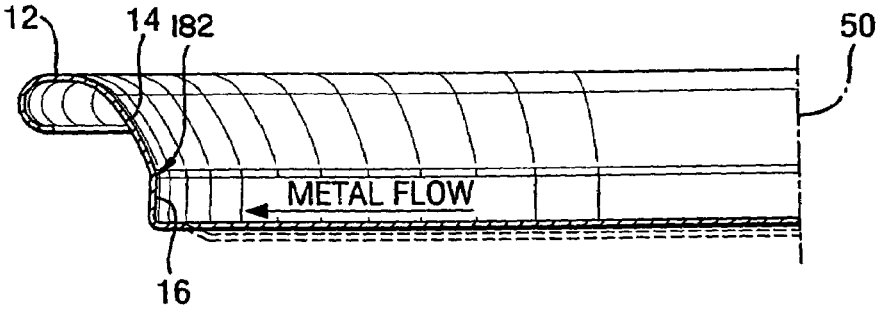
Figure 29:
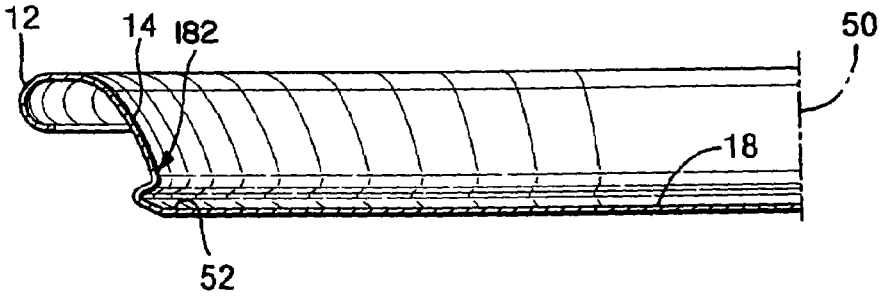
Figure 33:
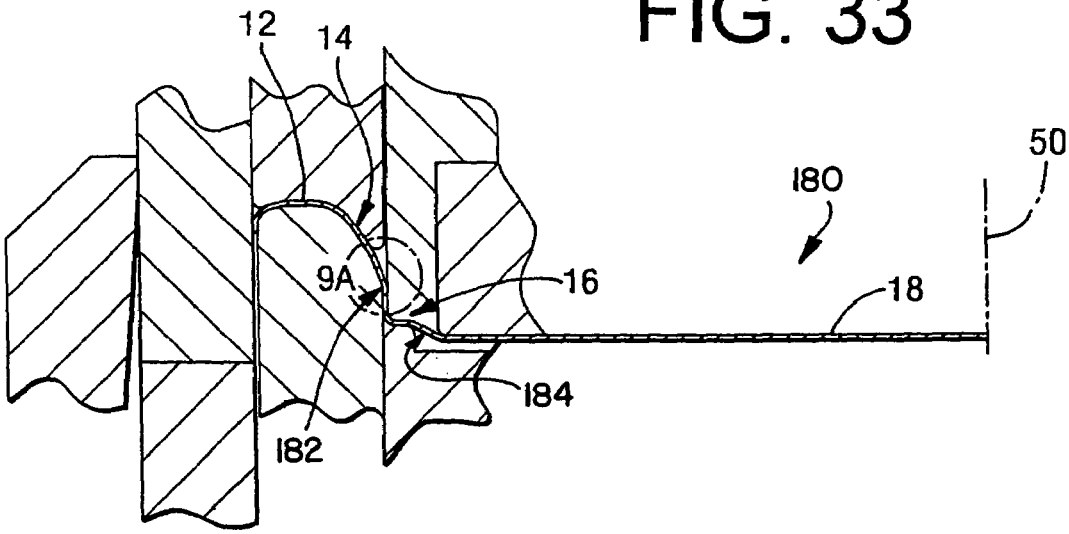
FIG. 33-37 are partial cross-sectional views of a can end member and tooling of the present invention shown in forming stages.
Figure 33A:
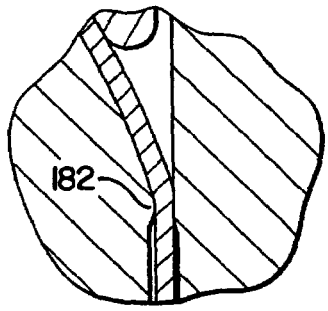
Figure 34:
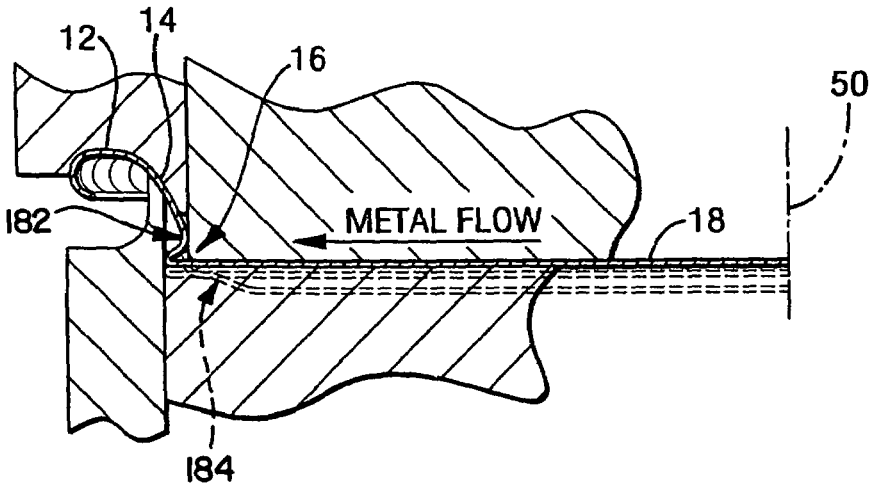

Referring to FIGS. 27 and 33, the method includes the step of providing an end shell 180. The end shell 180 includes a hinge point 182 formed at the junction between the chuck wall 14 and the transition wall 16. In FIG. 28, the hinge point 182 is a coined portion on an interior of the end shell 180. In FIG. 33, the hinge point 182 is a coin on the exterior of the end shell 180. The hinge point 182 may also be provided along the peripheral edge 52 of center panel 18. The hinge point 182 is provided to initiate bending at a predetermined point along the chuck wall 14/transition wall 16. In this example, the hinge point 182 defines the boundary between the chuck wall 14 and the transition wall 16.

The end shell 180 also includes an angled portion 184 along the peripheral edge 52 of the center panel 18. This angled portion is formed to promote stacking of the end shells 180 as they are transported from a shell press to a conversion press. The angled portion 184 also promotes metal flow outwardly relative to the longitudinal axis 50 to promote formation of the fold 54 in the conversion press.

FIGS. 28-32 and 34-37 show a process of converting the end shell 180 to the finished end member 10 in a four stage operation carried out in a conversion press. The illustrated process depicts a die forming operation; however, the can end 10 of the present invention can also be formed by any forming technique, e.g., roll forming.

In the first stage (FIGS. 28, 29, and 34), relative movement between the tooling members causes an outward bulge (the beginning of the annular convex portion 64) to form in the transition wall 16. The bending of the transition wall 16 is initiated at the hinge point 182 (the beginning of the annular concave portion 58). At the same time, the angled portion 184 of the peripheral edge 52 is flattened to form the peripheral edge 52 into a planar structure. The relative movement of the tooling also causes the hinge point 182 to move towards the flattened peripheral edge 52 of the center panel 18.

Figure 30:
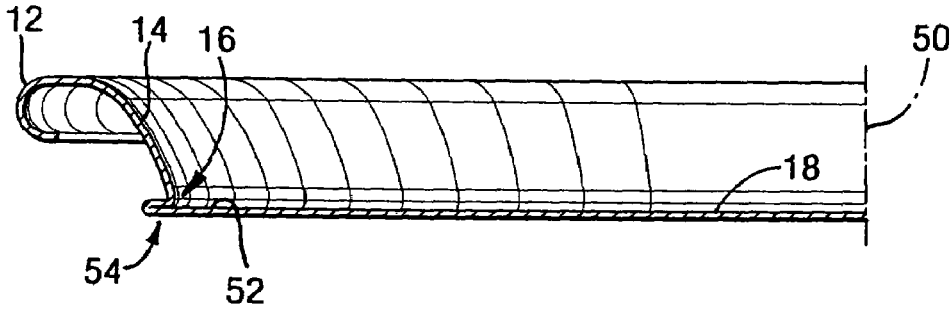
Figure 35:
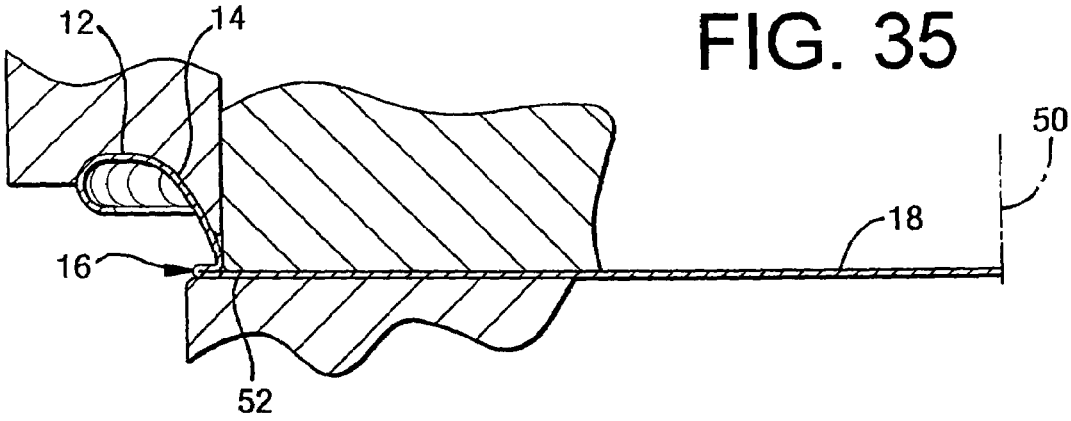

FIGS. 30 and 35 illustrate the second stage of the conversion press. In the second stage, relative movement by the tooling forces the hinge point 182 towards the peripheral edge portion 52. The annular convex portion is fully formed and extends outwardly substantially perpendicular to the longitudinal axis 50. A portion of the hinge point 182 is engaging or very nearly engaging the peripheral edge 52 of the center panel 18.

Figure 31:
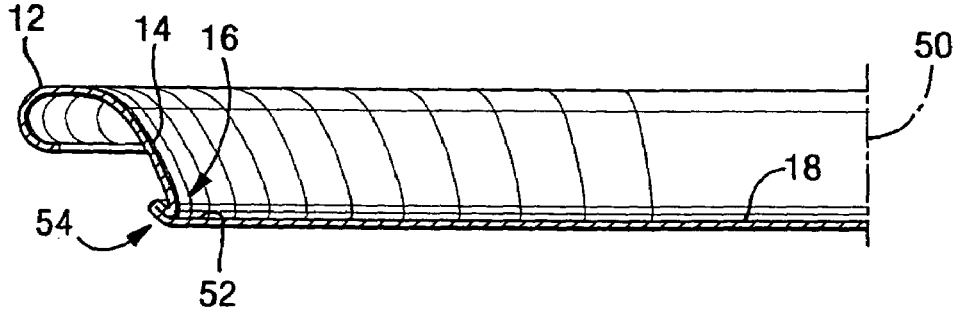
Figure 36:
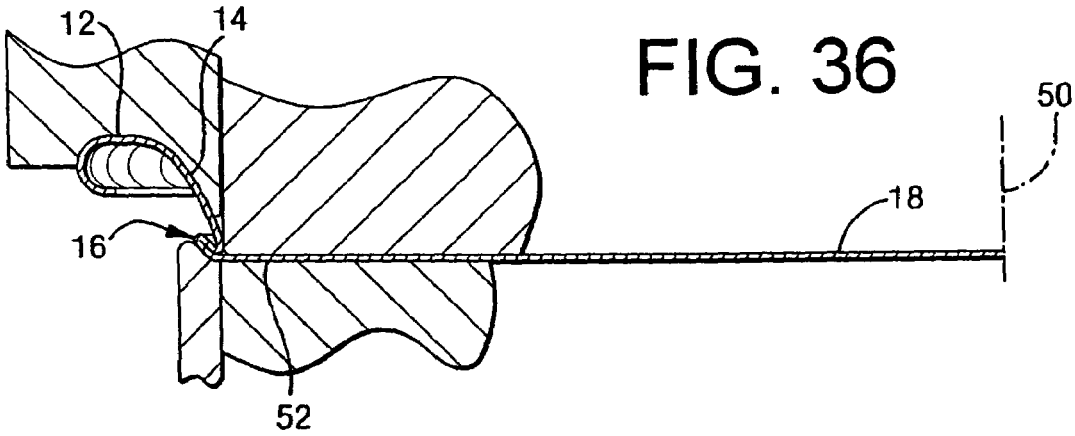

FIGS. 31 and 36 illustrate the third stage of the conversion press. In the third stage, relative movement by the tooling forces the fold 54 upwardly and, consequently, inwardly relative to the center panel 18. This forms the third bend and shortens a radius of curvature of the annular concave portion.

Figure 32:
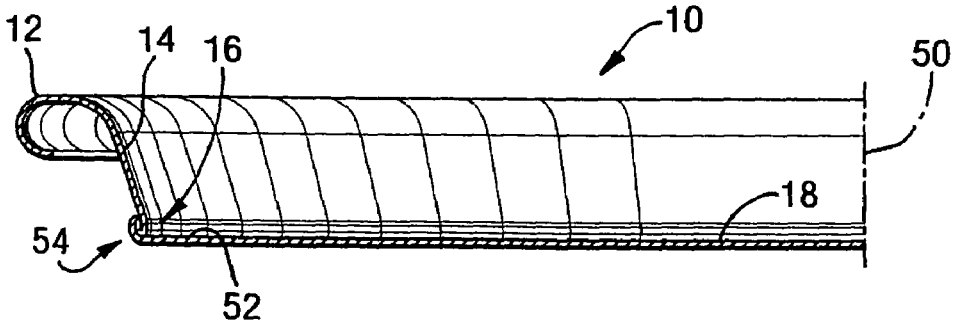
Figure 37:
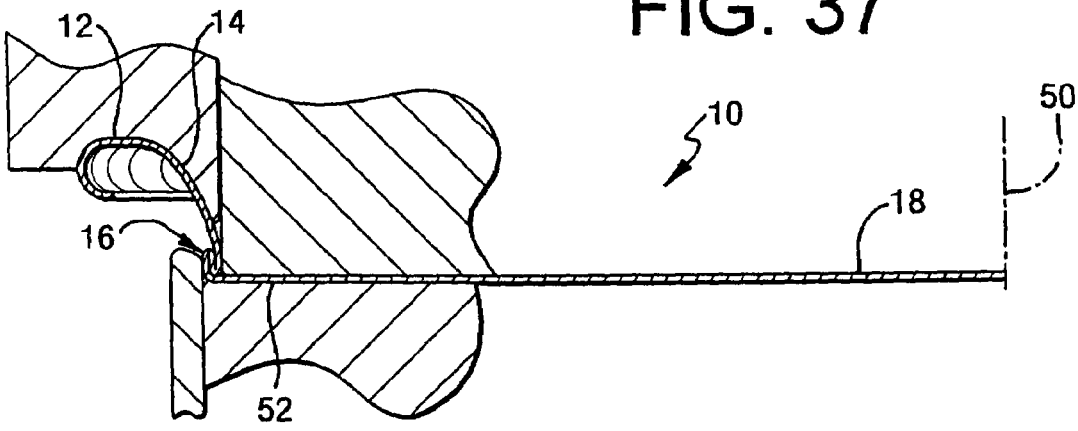

FIGS. 32 and 37 illustrate the fourth stage of the conversion press. In the fourth stage, relative movement by the tooling forces the fold 54 farther upwardly and inwardly relative to the center panel 18 until the fold 54 is substantially vertical, parallel with the longitudinal axis 50. The annular concave portion 58 is fully formed and is in engagement or very nearly in engagement with the peripheral edge portion.

Figure 38:
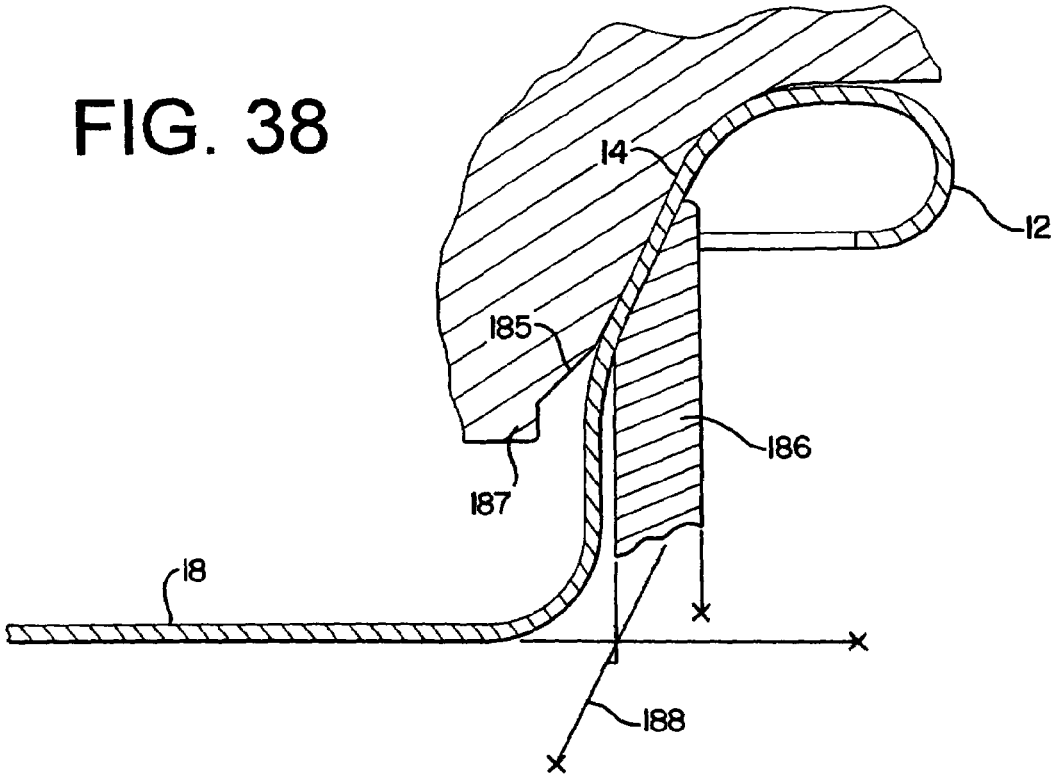
FIG. 38-40 are partial cross-sectional views of a can end member and alternative tooling of the present invention shown in forming stages.
Figure 39:
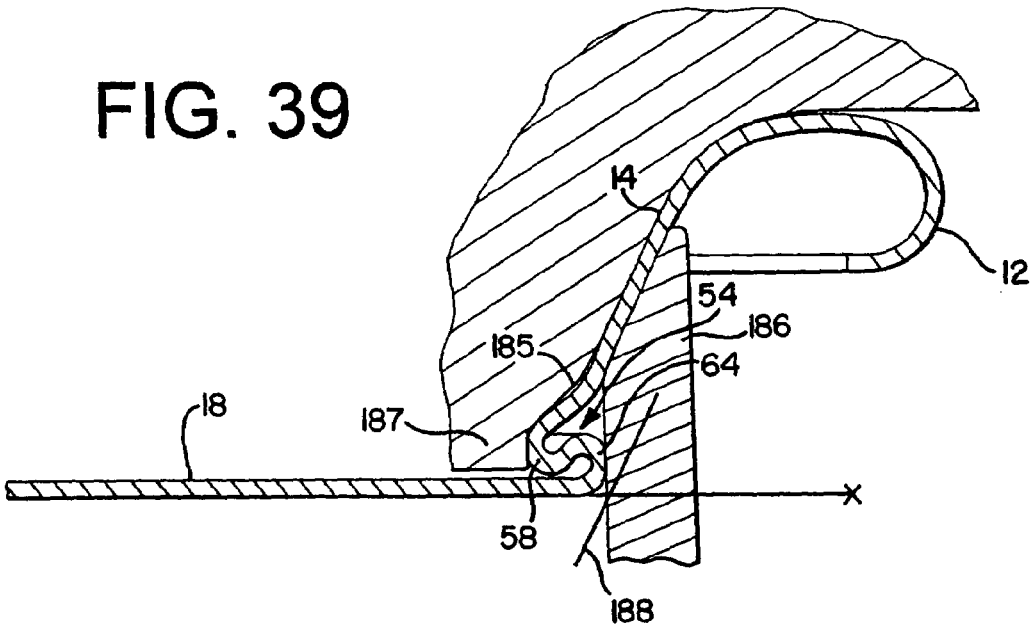
Figure 40:
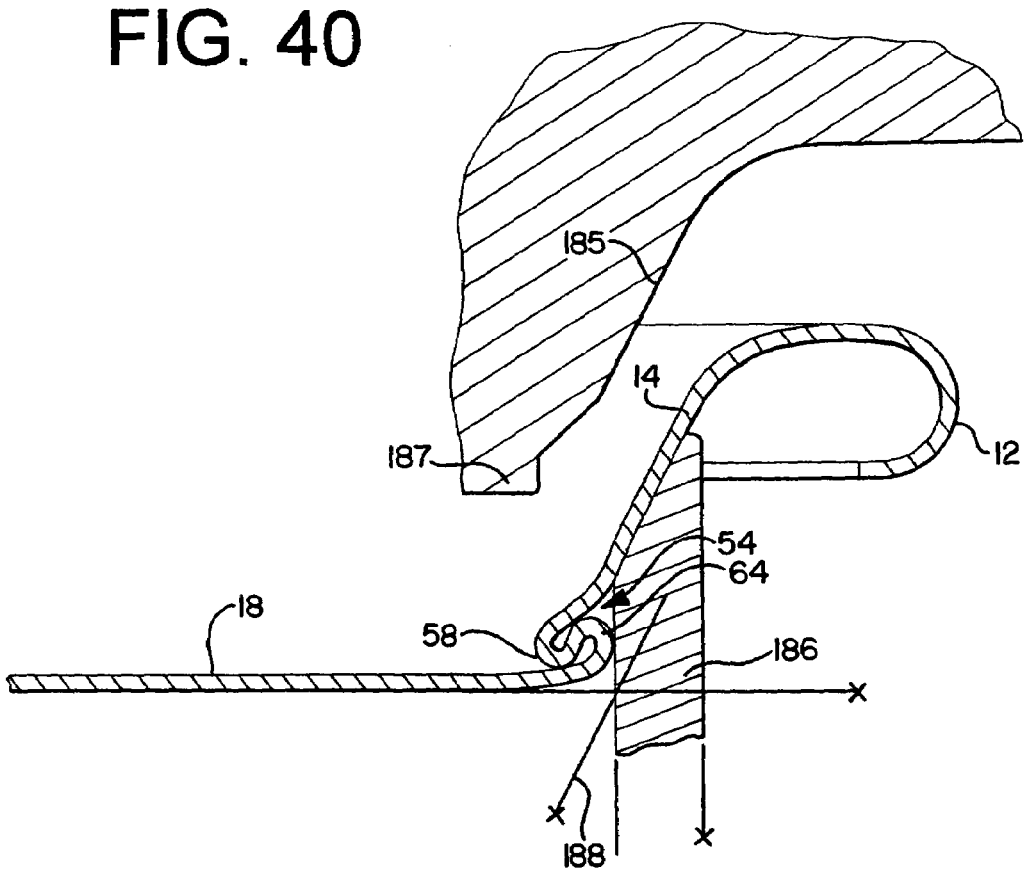

Alternative tooling is illustrated in FIGS. 38-40. The tooling of FIGS. 38-40 forms the fold 54 by forcing metal inwardly, whereas the tooling discussed previously formed the fold 54 by forcing metal outwardly. In FIGS. 38-40, the fold 54 is produced by fixing chuck wall 14 between upper tool 185 and lower tool 186. Upper tool 185 includes extension 187. The extension 187 prevents the fold 54 from expanding inwardly relative to the longitudinal axis. Thus, the upper and lower tools 185 and 186 maintain the fold 54 in compression. This type of tooling is aimed at maintaining the approximately equal levels of stress at the annular concave and convex portions 58 and 64 to eliminating the premature fracture during forming. A third tool or tool portion 188 forces the fold 54 upwardly and inwardly.

Figure 41:
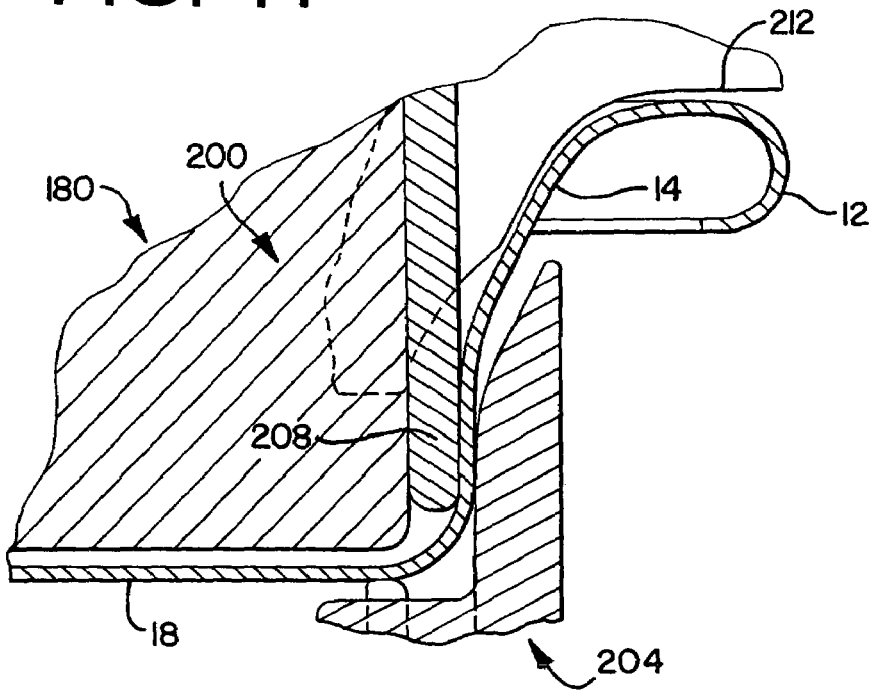
FIGS. 41 and 42 are partial cross-sectional views of a can end member of FIG. 11 and alternative tooling of the present invention shown in forming stages.
Figure 42:
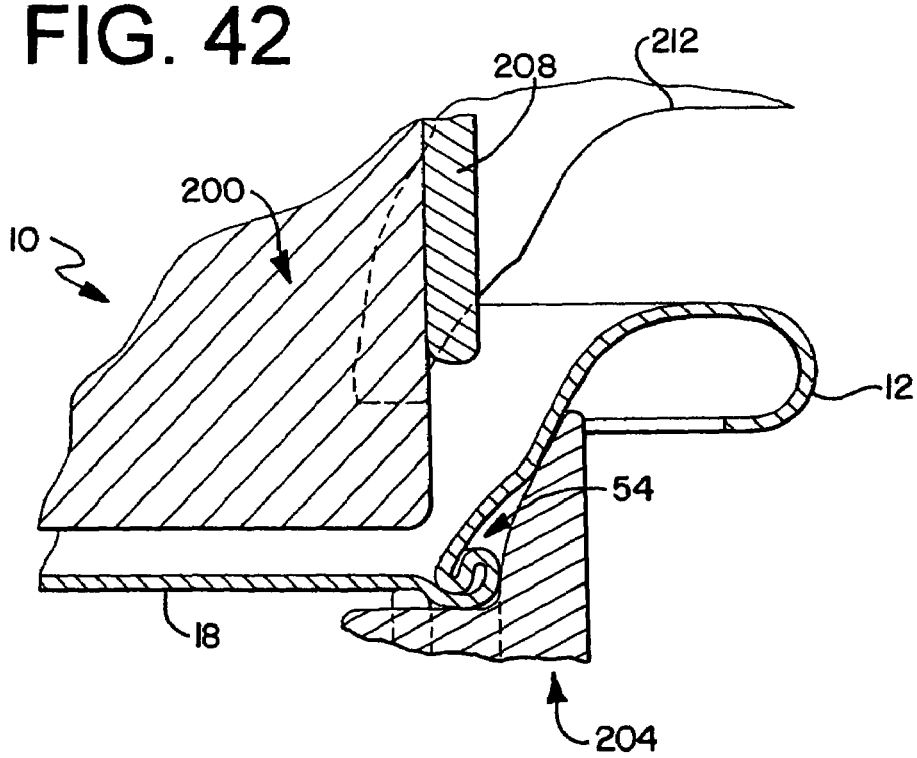
Figure 43:
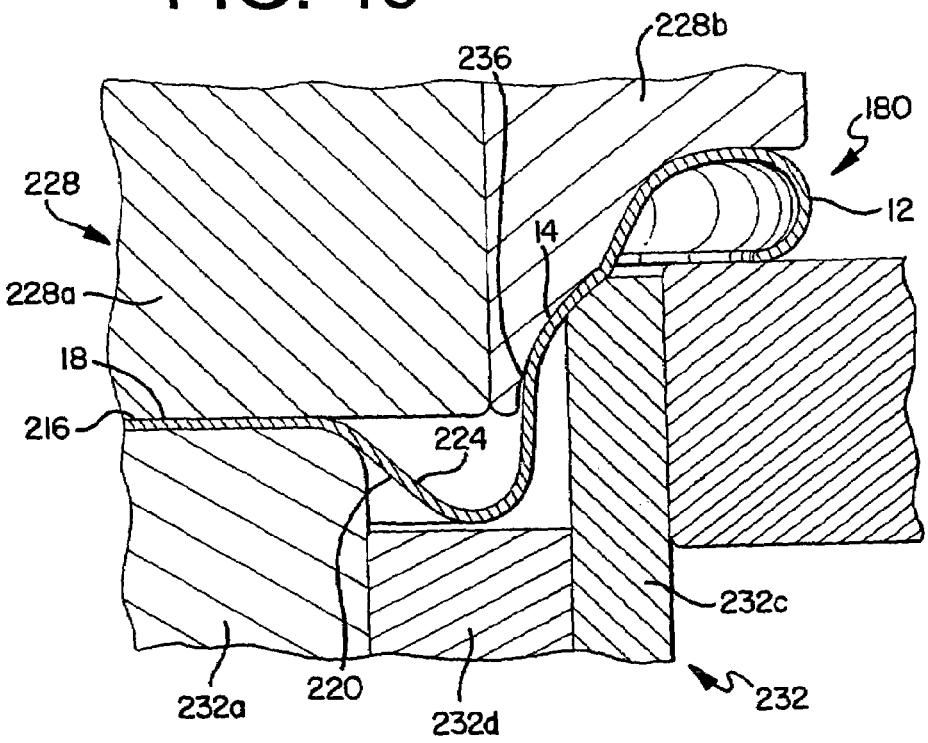
FIGS. 43-46 are partial cross-sectional views of a can end member and tooling of the present invention shown in forming stages.
Figure 44:
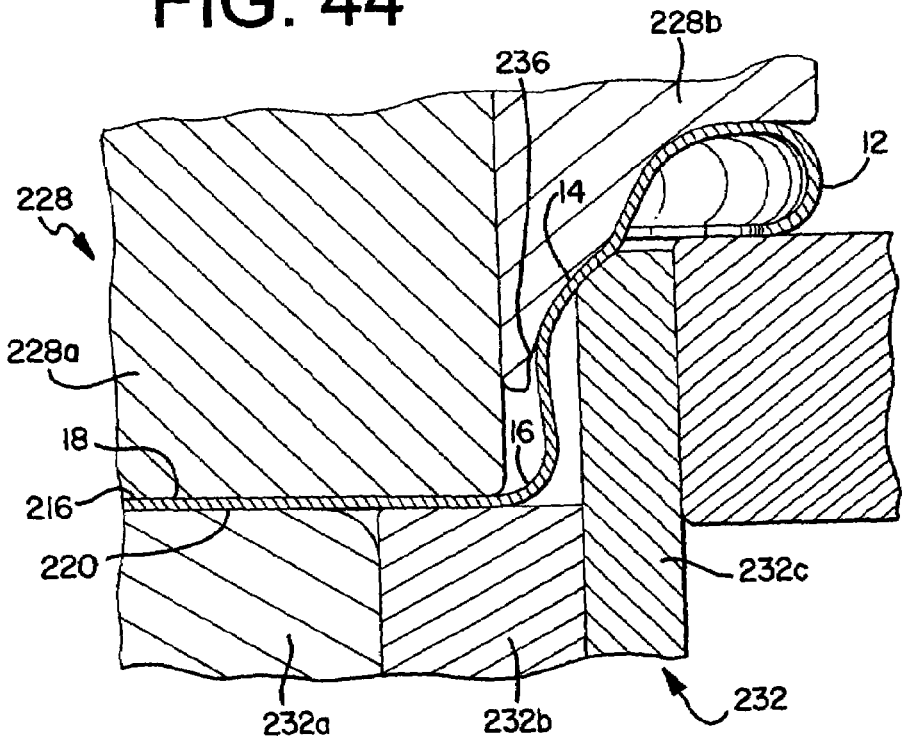
Figure 45:
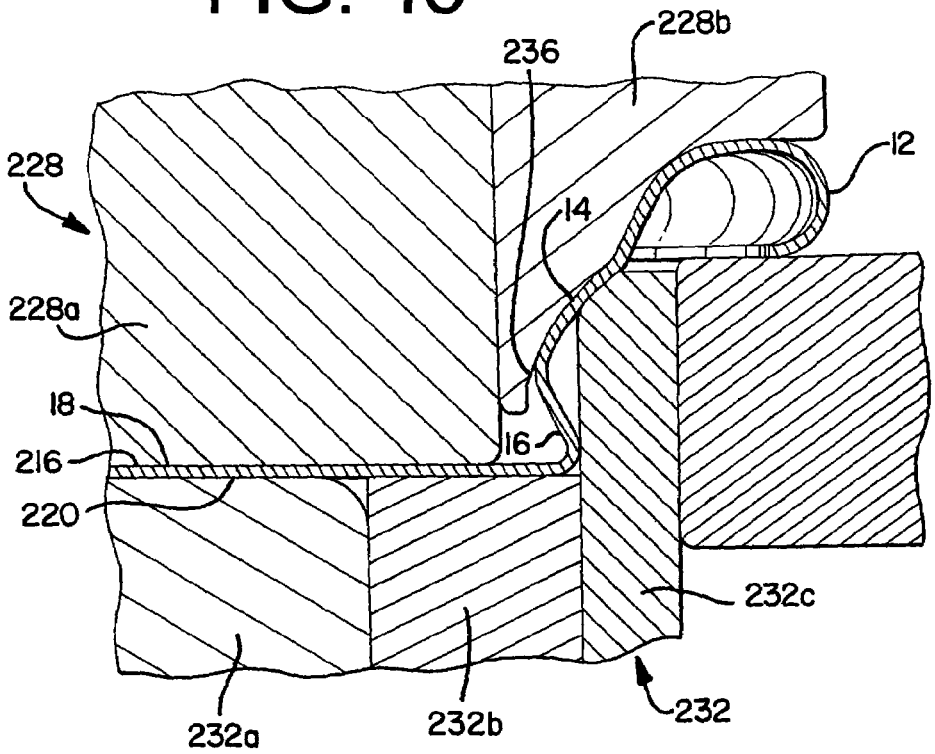
Figure 46:
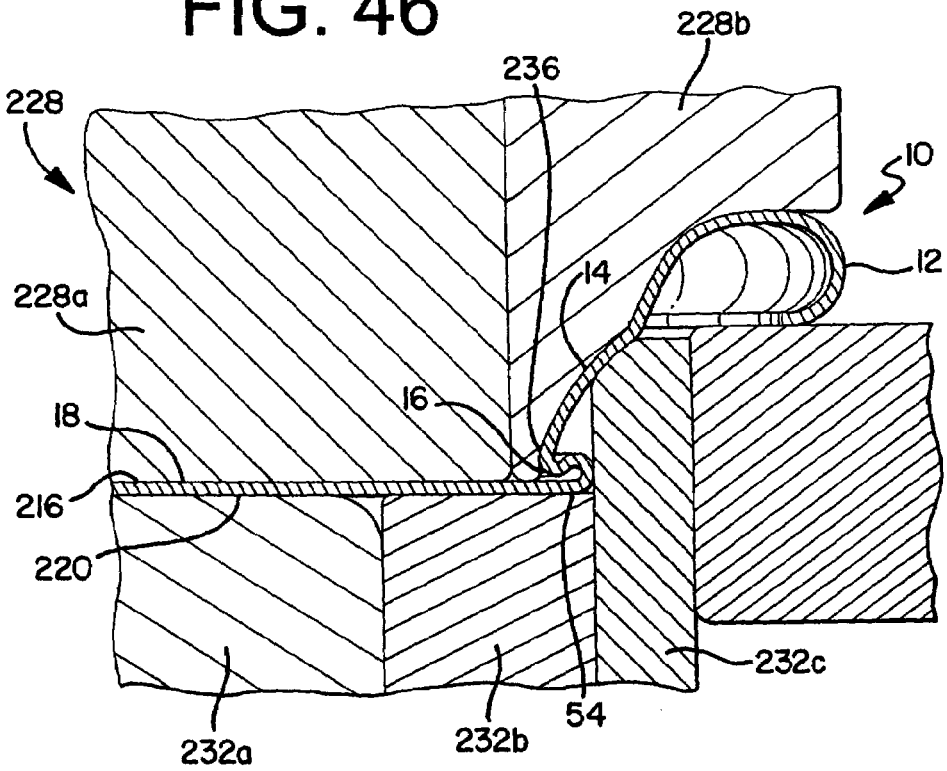

The end member 10 of FIG. 11 can be formed using the tooling shown in FIGS. 41 and 42. The tooling of these Figures represent a two-stage operation. The tooling includes upper tooling 200 and lower tooling 204. The upper tooling 200 has an intermediate member 208. Relative movement between the upper tooling 200 and the lower tooling 204 causes the intermediate member 208 to engage the peripheral edge of the shell member 180, forcing the peripheral edge downwardly to form a recess. The intermediate member 208 retracts, and an outer member 212 engages the chuck wall 14 in the second stage of the operation. As the chuck wall 14 is forced downwardly, the fold 54 is formed between the lower tooling 204 and the outer member 212.

Now referring to FIGS. 43-46, an alternative method of manufacturing an easy open can end member 10 of the present invention is illustrated. In this method, a can end shell 180 is reformed to exhibit a fold 54 and an arcuate chuck wall 14.

The method includes providing a can end shell 180. The can end shell 180 has a public side 216 and an opposing product side 220. The shell 180 includes a center panel 18 disposed about a longitudinal axis 50, a generally U-shaped countersink 224, an annular arcuate chuck wall 14, and a curl 12 defining an outer perimeter of the can end shell 180. The generally U-shaped countersink 224 joins the chuck wall 14 with the center panel 18.

Upper and lower tooling 228, 232 are also provided. The upper tooling 228 includes first and second forming members 228*a*, 228*b*. The first forming member 228*a* is positioned radially inwardly from the second forming member 228*b*. The second forming member 228*b* has an annular arcuate portion 236 for contacting the annular arcuate portion of the chuck wall 14.

The lower tooling 232 comprises inner, intermediate, and outer forming members 232*a*, 232*b*, 232*c*. The inner forming member 232*a* is located radially inwardly from the intermediate forming member 232*b*, and the intermediate forming member 232*b* is located radially inwardly from the outer forming member 232*c*. The outer forming member 232*c* has a portion adapted for contacting the product side 220 of the annular arcuate chuck wall 14.

The can end shell 180 is supported between the upper and lower tooling 228, 232. Relative movement between the can end shell 180 and the upper and lower tooling 228, 232 reforms the can end shell 180. Preferably, the first forming member 228*a* of the upper tooling 228 contacts the public side 216 of the center panel 18; the second forming member 228*b* contacts the annular arcuate chuck wall 14. The inner forming member 232*a* of the lower tooling member 232 contacts the product side 220 of the center panel 18. The intermediate forming member 232*b* contacts the U-shaped countersink 224, and the product side 220 of the annular arcuate chuck wall 14 is contacted by the outer forming member 232*c*.

Next, the first forming member 228*a* of the upper tooling 228 forces the center panel 18 downwardly. This increases the radius of curvature of the U-shaped countersink 224. As the reforming continues, the U-shaped countersink 224 is removed, and an area of the center panel 18 is increased radially outwardly.

Following the reforming of the center panel 18, the second forming member 228*a* of the upper tooling 228 moves downwardly. The outer forming member 232*c* of the lower tooling also moves downwardly. The intermediate forming member 232*b* of the lower tooling 232 supports the expanded area of the center panel 18. This relative movement causes reforming of the annular arcuate chuck wall 14.

As the chuck wall 14 is forced downwardly, the transition wall 16 is formed. A portion of the chuck wall 14, which was formerly an outer wall of the U-shaped countersink 224, moves radially outwardly until it abuts a portion of the outer forming member 232*c* of the lower tooling 232. This prevents further outward movement of the chuck wall 14, and the metal that forms the transition wall 16 free forms a fold portion 54. A remaining lower portion of the chuck wall 14 moves radially inwardly against a portion of the second forming member 228*b* of the upper tooling 228.

FIGS. 47-52 illustrate a double-action can end shell forming operation of the present invention. The press includes an inner and an outer slide or ram having two different stroke lengths. The stroke length of the outer slide is approximately 2.5 ins. (63.5 mm). The stroke length of the inner slide in approximately 4 ins. (101.6 mm). The phase angle is approximately 25 degrees. The stroke and phase angle may differ depending on forming requirements and other manufacturing variables. In this operation, a cut edge metal blank is formed into a can end shell having a fold portion. The shell is subsequently transferred to a conversion press for further forming.

Figure 47:
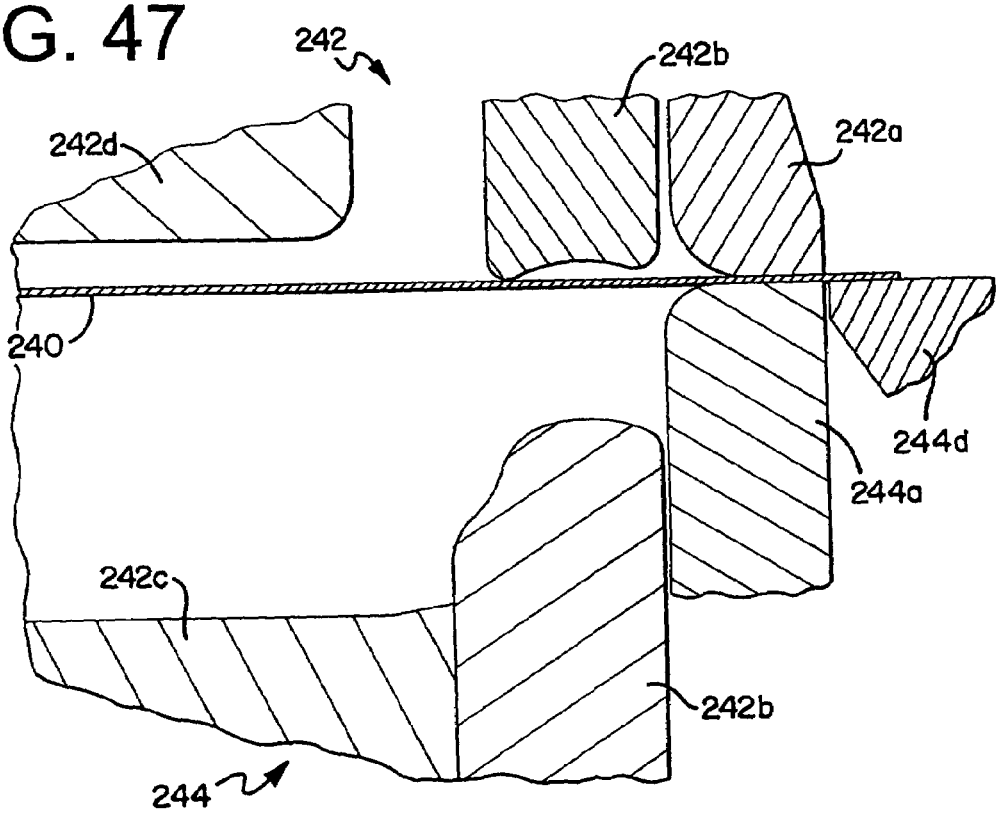
FIGS. 47-52 are partial cross-sectional views of a can end shell and shell press tooling of the present invention shown forming stages.

FIG. 47 illustrates the initial step in the shell forming process. In this step, a cut edge metal blank 240 is provided. Again, upper and lower tooling 242, 244 are provided for forming the shell from the cut edge blank 240. The upper tooling 242 comprises a radially outermost upper tool 242*a*, a first intermediate upper tool 242*b* located radially inwardly of the outermost upper tool 242*a*, a second intermediate upper tool 242*c* (see FIGS. 48-52) located radially inwardly of the first intermediate upper tool 242*b*, and a radially innermost upper tool 242*d* located radially inwardly of the second intermediate tool upper 242*c*. The lower tooling 244 comprises a radially outermost lower tool 244*a*, an intermediate lower tool 244*b* located radially inwardly of the outermost lower tool 244*a*, and a radially innermost lower tool 244*c* located radially inwardly of the intermediate lower tool 244*b*. A blanking tool 244*d* is located radially outwardly of the outermost lower tool 244*a*.

As shown in FIG. 47, in a first stage, a peripheral edge of the blank 240 is held by an outer ring formed by the upper and lower radially outermost tools 242*a*, 244*a*.

Figure 48:
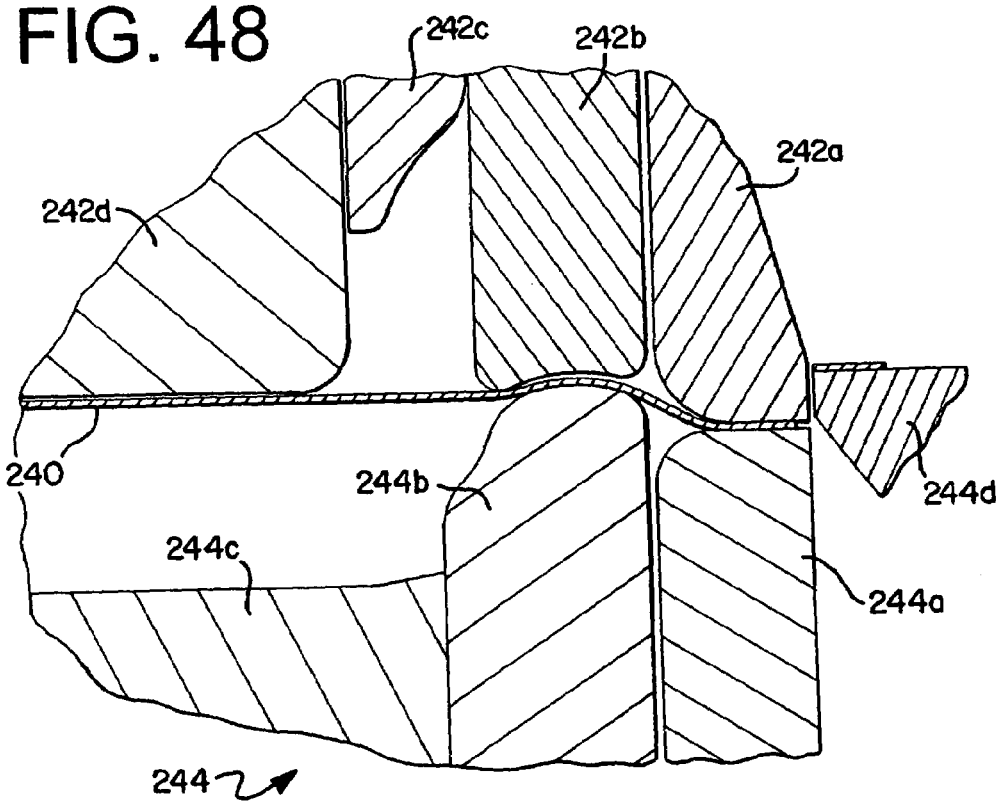

As shown in FIG. 48, relative movement between the upper and lower tooling 242, 244 causes the blank 240 to be sheared by the blanking tool 244*d*. A portion of the blank 240 to wrap around an outwardly convex arcuate section of the intermediate lower tool 244*b*. The first intermediate upper tool 242*b* has an outwardly concave portion for pinching the blank 240 against the outwardly convex arcuate portion of the intermediate lower tool 244*b*.

Figure 49:
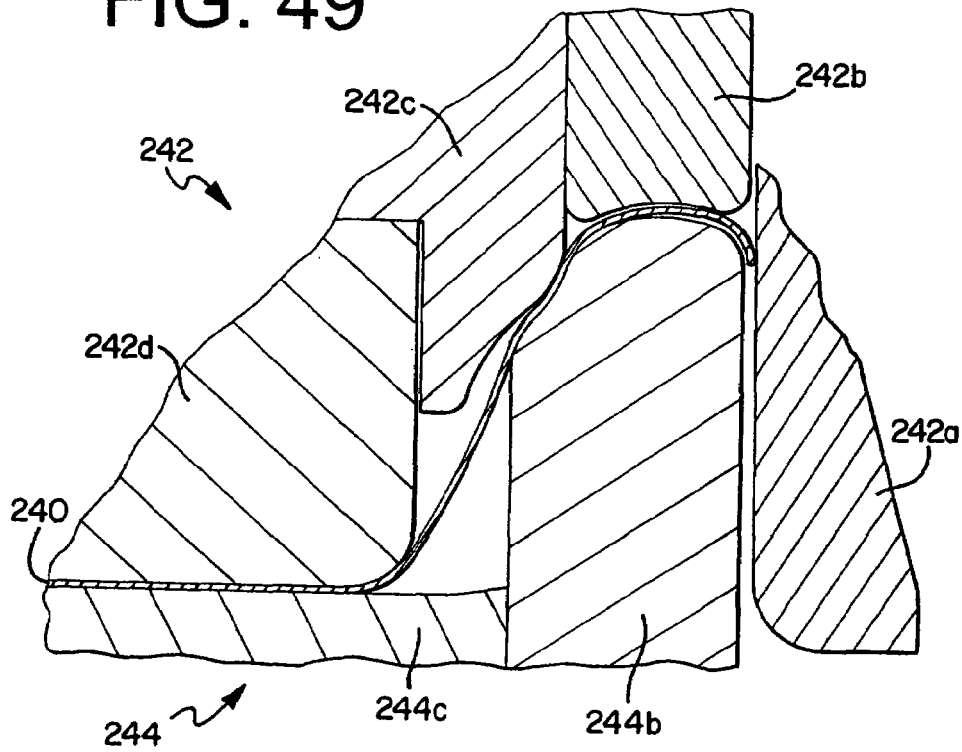

As shown in FIG. 49, relative movement between the upper and lower radially innermost tooling 242*d*, 244*c* forms a cup in the blank 240 as the outer peripheral edge of the blank 240 is retained between the first intermediate upper tool 242*b* and the intermediate lower tool 244*b*. The radially innermost lower tool 244*c* is kept under pressure to upwardly bias the tool. The pressure biasing the innermost lower tool 244*c* keeps the tool held firmly against the product side of the shell to prevent the fold portion from unraveling during the forming process. Further, relative movement between the second intermediate upper tool 242*c* and the lower tooling 244 begins to form a chuck wall radially inwardly of the outer peripheral edge of the blank 240.

Figure 50:
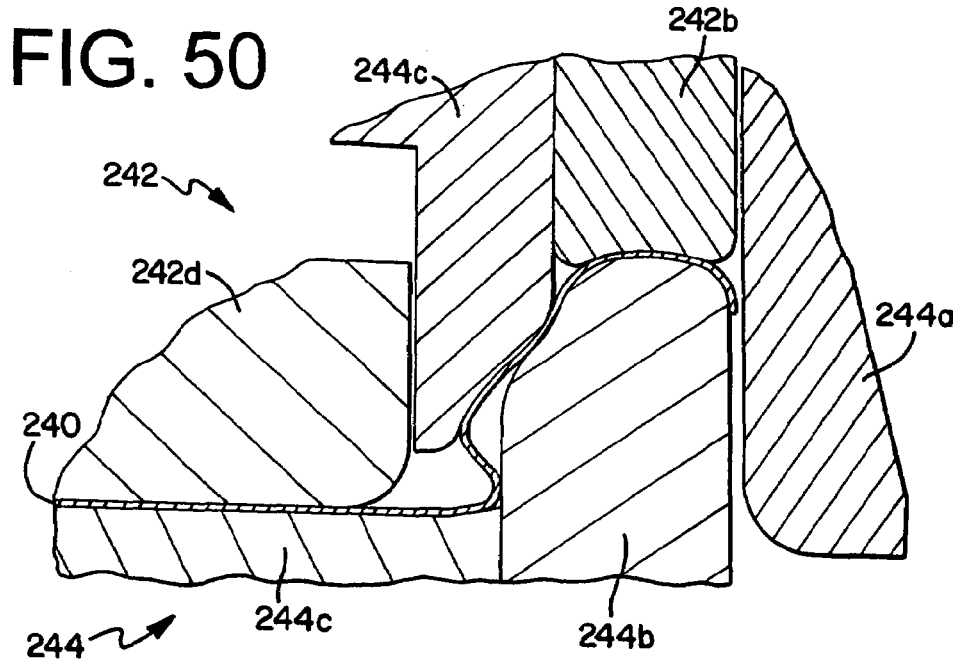

The forming continues as illustrated in FIG. 50. The relative movement between the upper and lower tooling 242, 244. A circumferential portion of the blank free forms between the second intermediate upper tool 242*c* and the intermediate lower tool 244*b*. The fold portion begins to form in this sequence.

Figure 51:
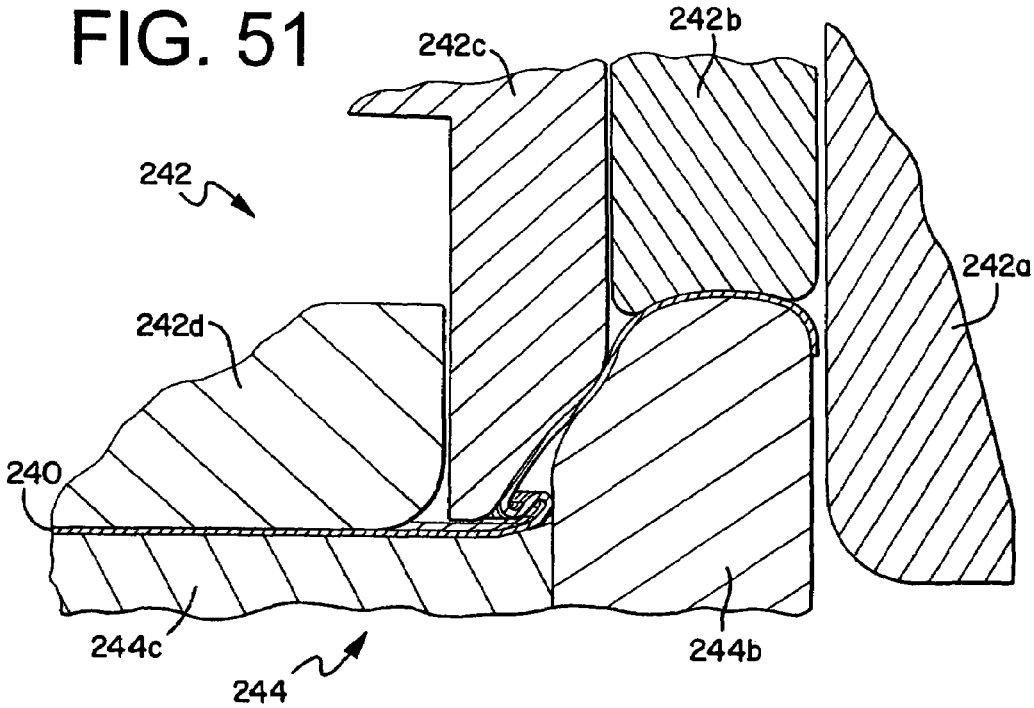

FIG. 51 shows the upper and lower tooling 242, 244 in their fully traversed positions. The fold 54 is fully formed between the chuck wall 14 and the central panel 18, and the seaming curl 12 is partially formed.

Figure 52:
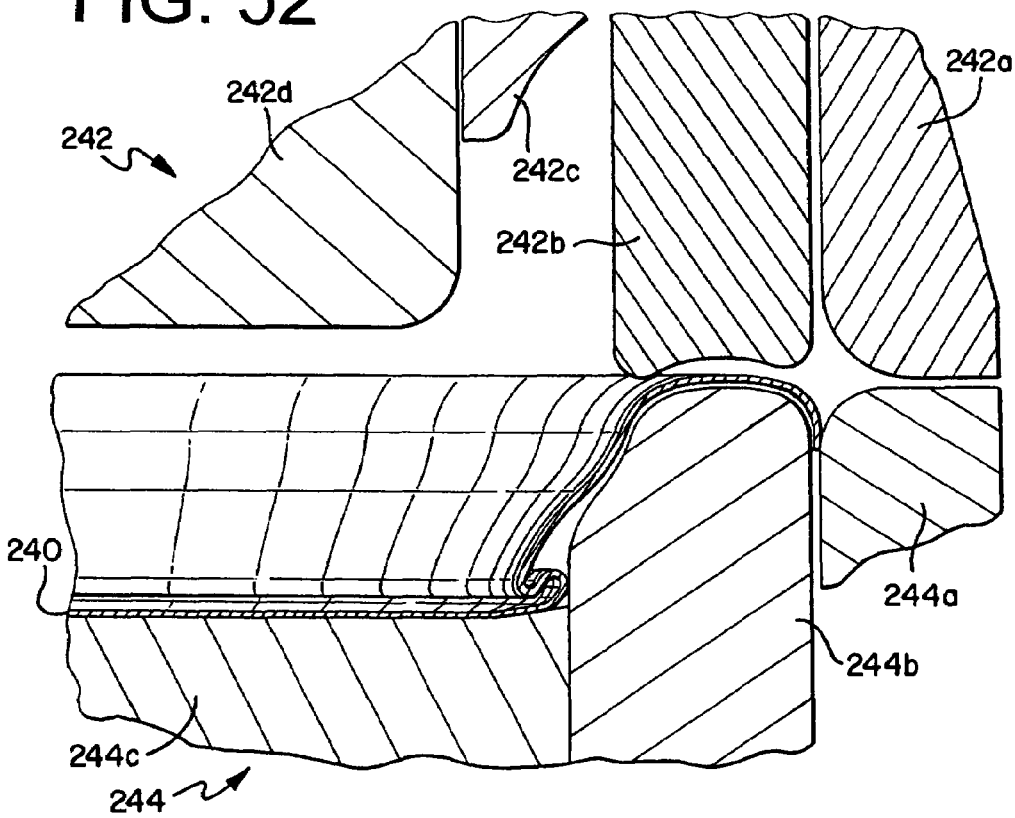

In FIG. 52, the upper and lower tooling is retracted. The can end shell 246 is fully formed.

FIGS. 53-57 illustrate a two operation process for forming a fold portion in conversion press. In this process a can end shell 248 in converted into a can end member having a fold portion. This operation also comprises upper and lower tooling 250, 252. The upper tooling 250 comprises a radially outermost tool 250*a*, a radially innermost tool 250*b*, and a second stage tool 250*c* (see FIGS. 55-57). The lower tooling 252 comprises radially outermost lower tool 252*a*, an intermediate lower tool 252*b*, and a radially innermost lower tool 252*c*.

Figure 53:
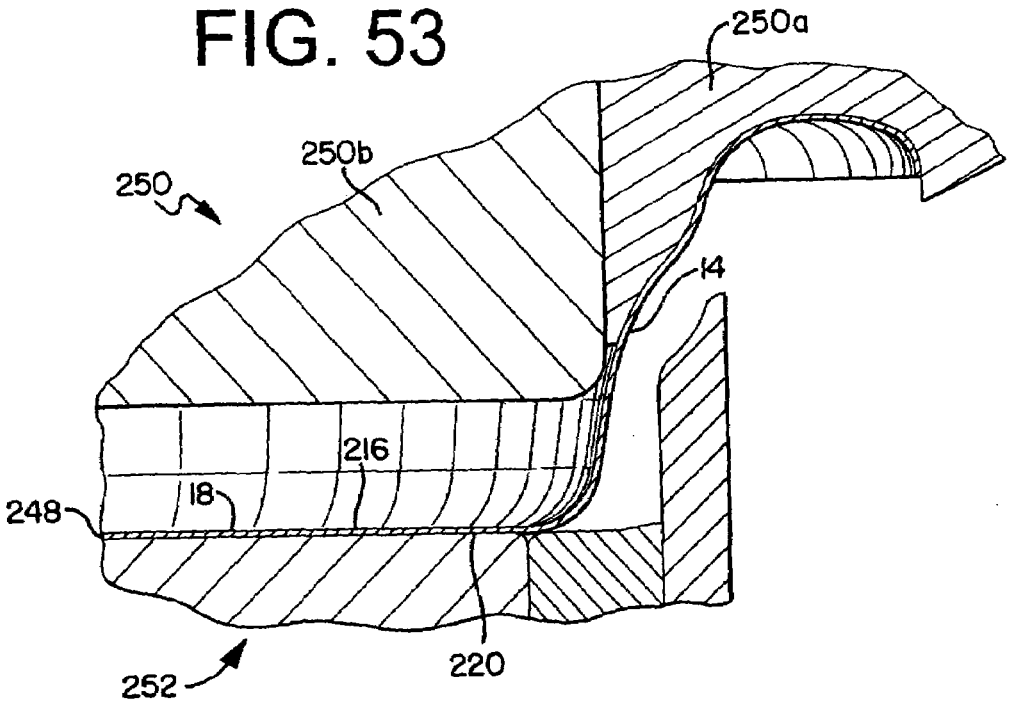
FIGS. 53-57 are partial cross-sectional views of a can end member and conversion press tooling of the present invention shown in forming stages.
Figure 54:
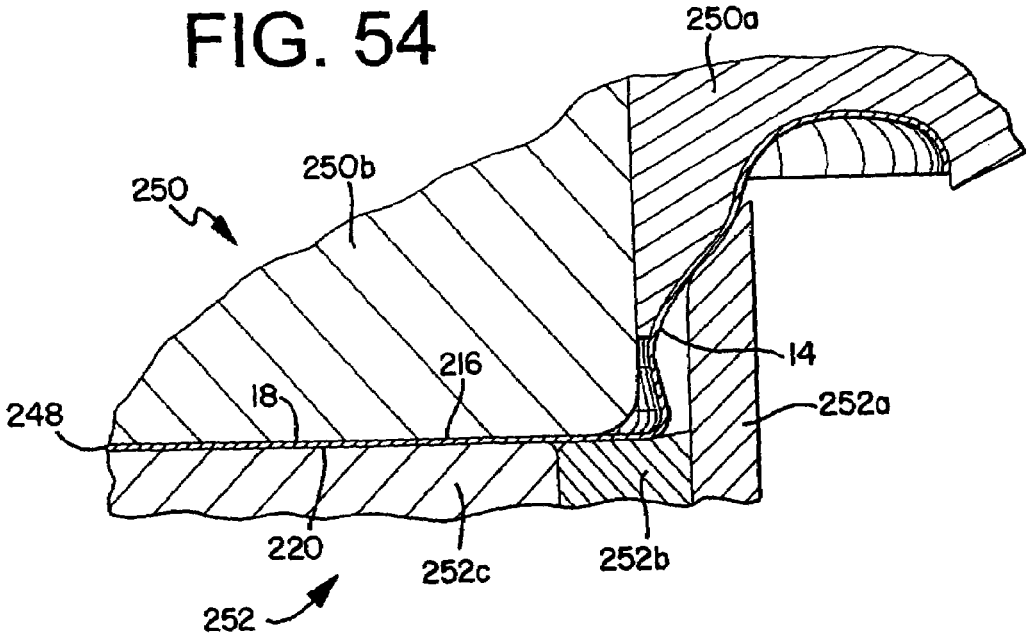

In the first operation, illustrated in FIGS. 53 and 54, relative movement between the upper and lower tooling 250, 252 causes the radially outermost upper tool 250*a* to engage the public side 216 of the can end shell 248, while the radially innermost lower tool 252*c* and the intermediate lower tool 252*b* engage the product side 220 of the shell 248. Continued relative movement causes the radially innermost upper tool 250*b* to engage the public side 216 of the shell 248. The radially outermost lower tool 252*a* supports the upper chuck wall 14 of the shell 248.

This continued relative movement causes the center panel 18 and the chuck wall 14 to be reformed. The center panel 18 is reformed radially outwardly. A lower portion of the chuck wall 14 free forms between the upper and lower tooling 250, 252, forming an S-shaped cross-sectional profile.

Figure 55:
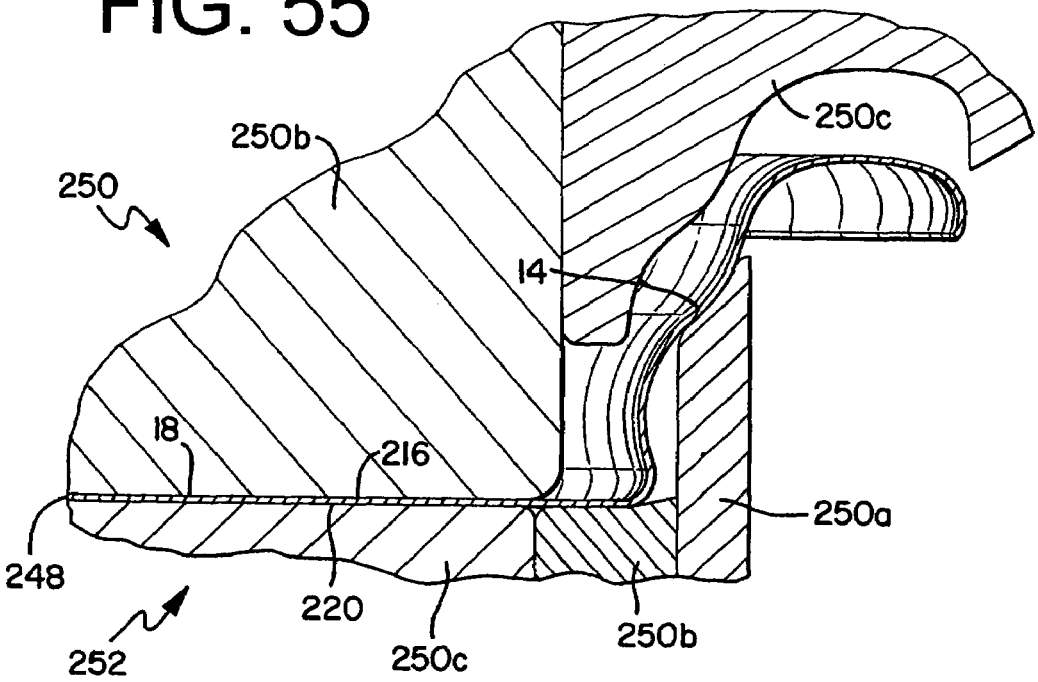
Figure 56:
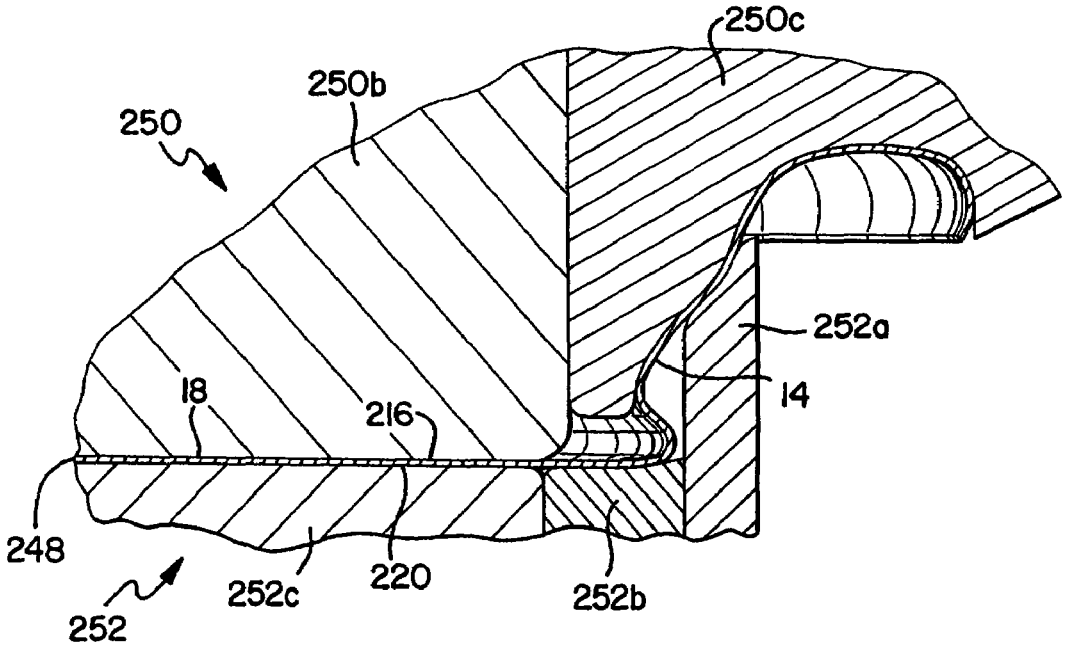
Figure 57:
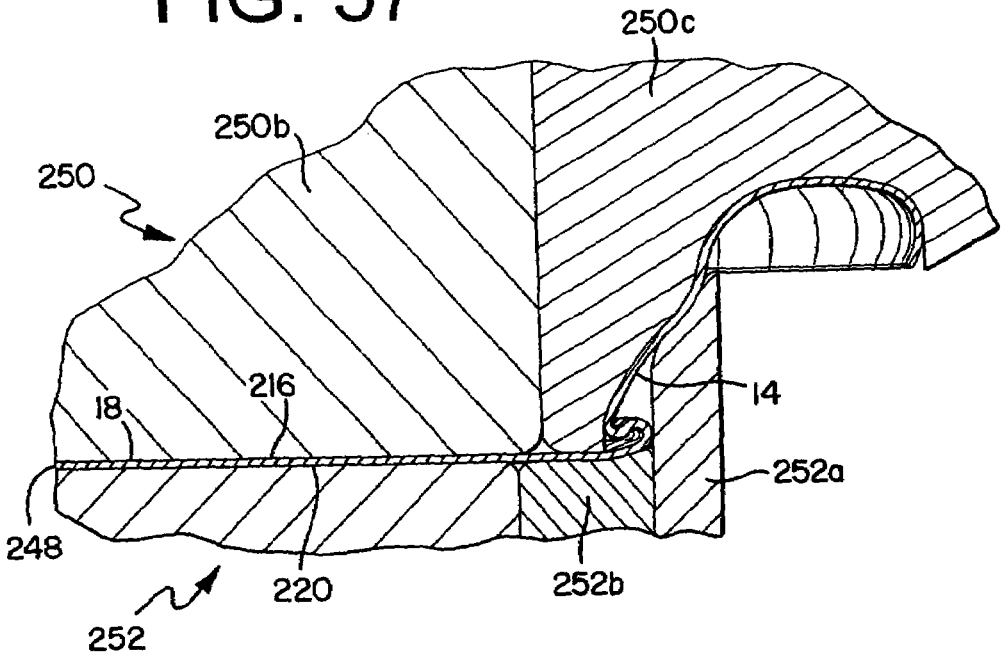
Figure 58:
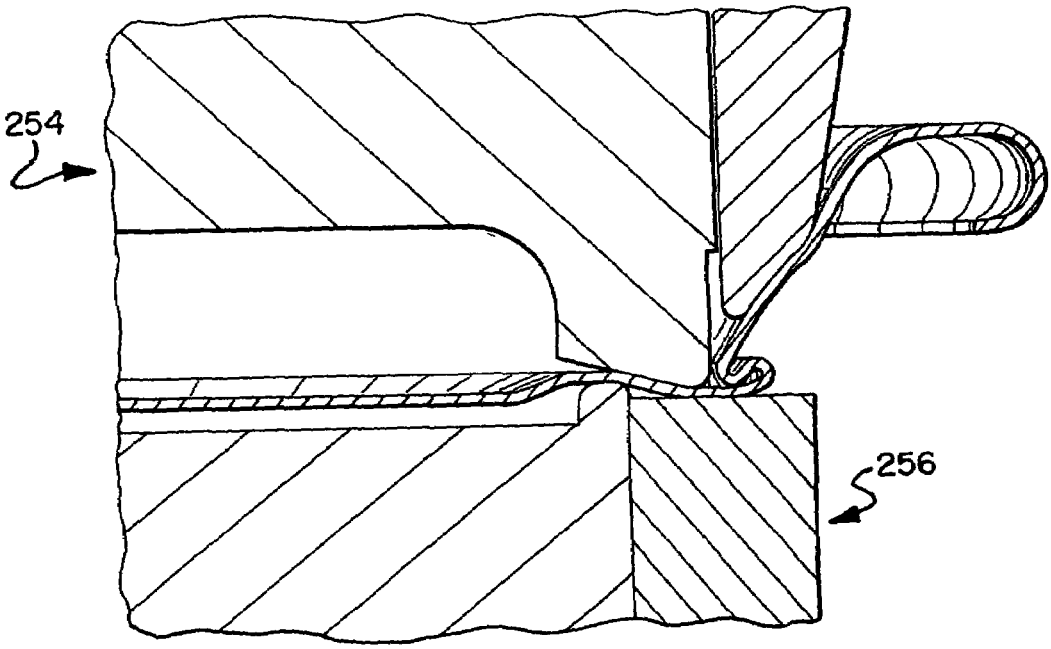
FIG. 58 is a partial cross-sectional view of a can end having a center panel with a stepped portion and tooling for performing a coining operation.
Figure 60:
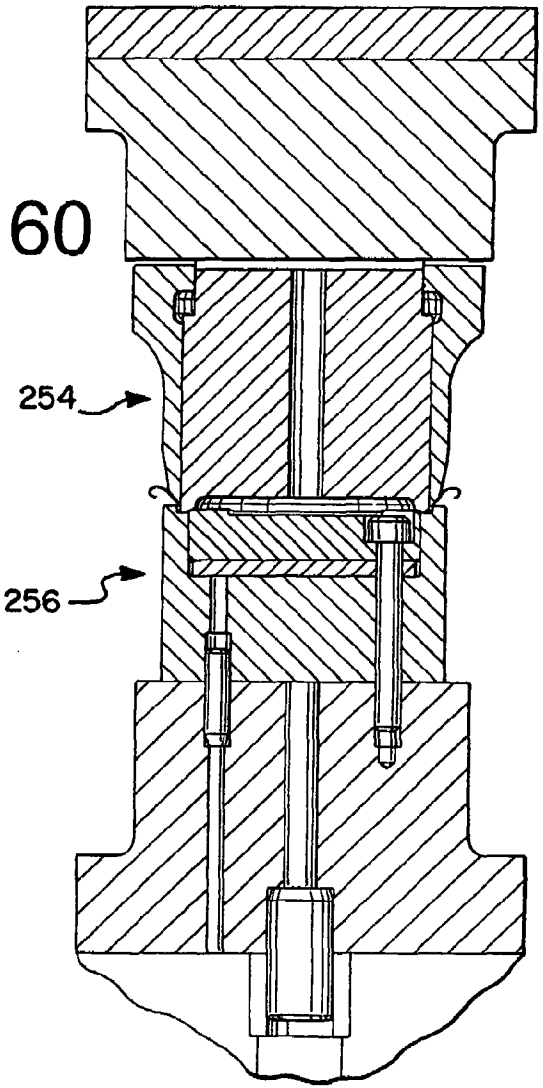
FIG. 60 is a cross-sectional view of a can end member having a center panel with a stepped portion and tooling for performing a coining operation.
Figure 59:
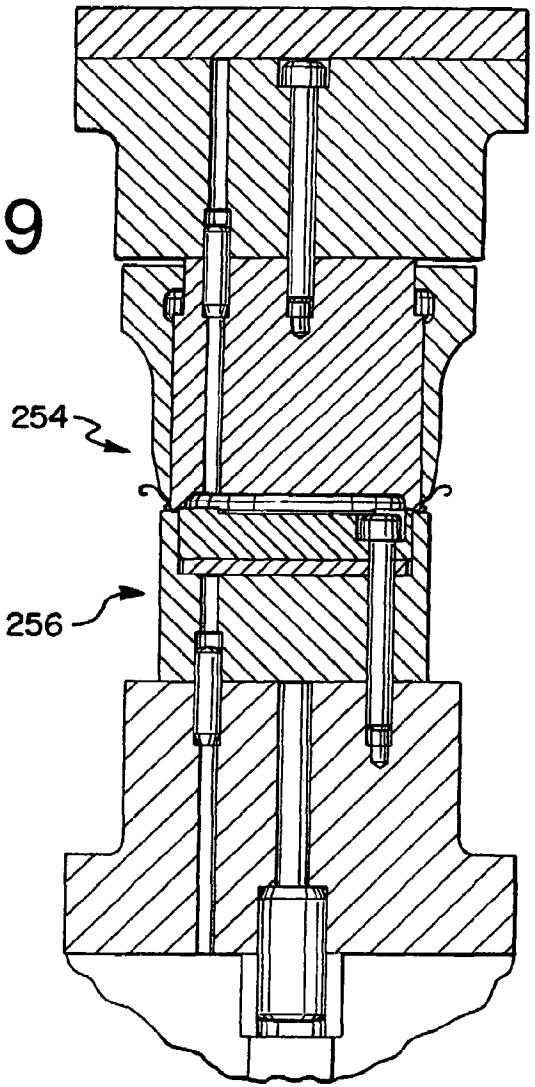
FIG. 59 is a cross-sectional view of a can end member having a center panel with a stepped portion and tooling for performing a coining operation.
Figure 61:
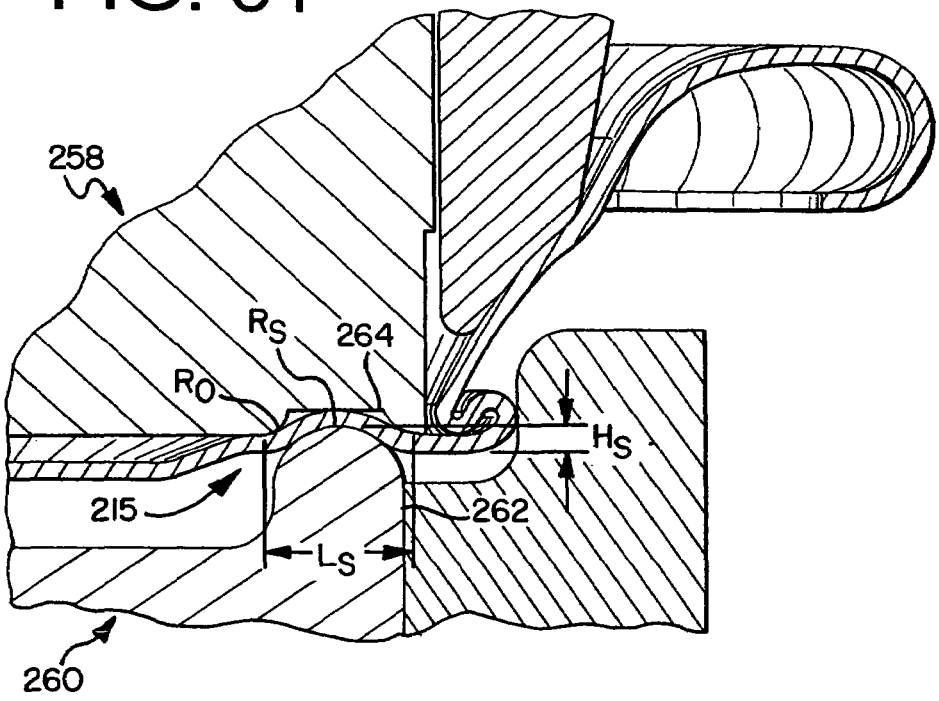
FIG. 61 is a partial cross-sectional view of a can end member having a stepped portion and tooling for producing the stepped portion.
Figure 62:
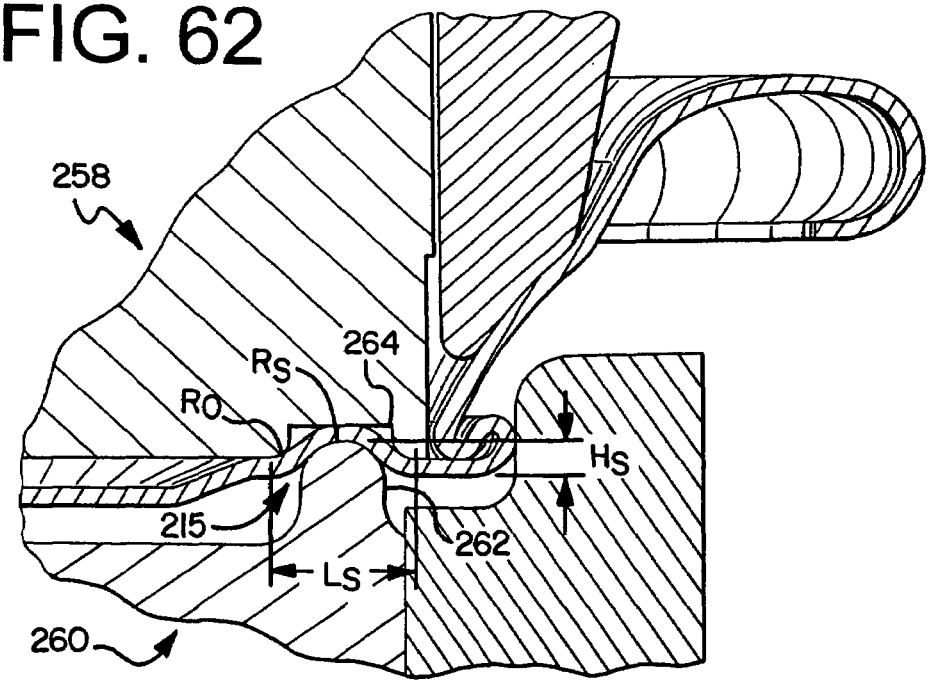
FIG. 62 is a partial cross-sectional view of a can end member having a stepped portion and tooling for producing the stepped portion.
Figure 64:
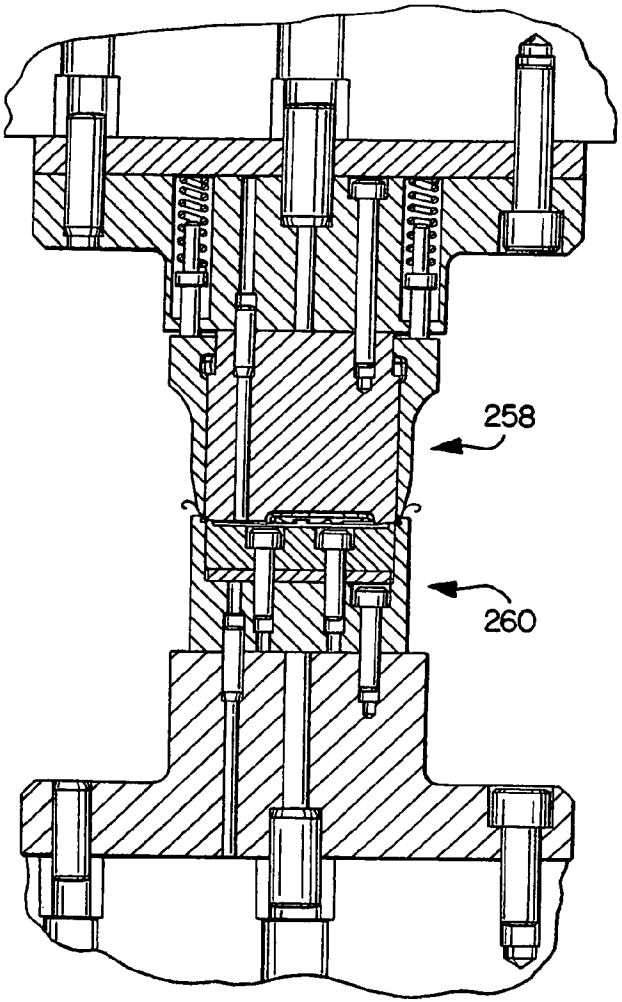
FIG. 64 is a cross-sectional view of a can end member having a center panel with a stepped portion and tooling for producing the stepped portion.
Figure 63:
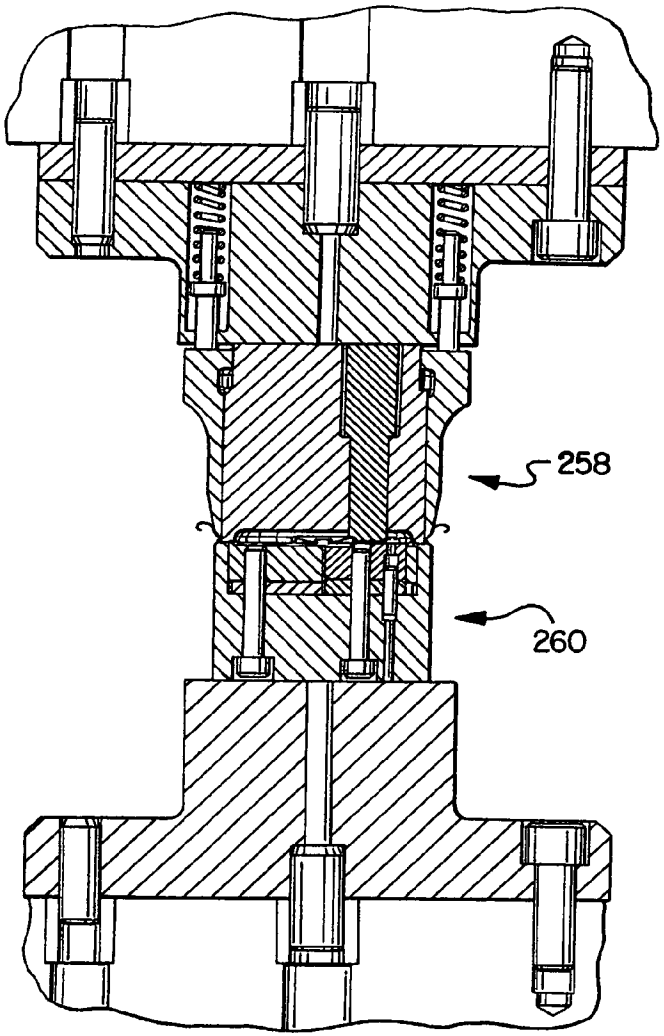
FIG. 63 is a cross-sectional view of a can end member having a center panel with a stepped portion and tooling for producing the stepped portion.

Once this reforming is complete, the radially outermost upper tool 250*a* retracts and is replaced by the second stage tool 250*c* (see FIGS. 55-57). The second stage tool 250*c* contacts the public side 216 of the chuck wall 14, forcing a lowermost portion of the chuck wall 14 outwardly while supporting a radially inner most portion of the chuck wall 14. Continued relative movement between the upper and lower tooling 250, 252 causes the fold portion to form between the second stage tool 250*c*, the intermediate lower tool 250*b*, and the radially outermost lower tool 252*a*.

FIGS. 58-64 illustrate optional methods for producing a stepped center panel portion. A coining operation, illustrated in FIGS. 58-60, first compresses a region of the center panel near the fold portion between upper and lower tooling 254, 256. This coining operation displaces metal, creating slack metal from which to form the step 215. The coining operation helps to prevent the fold portion from un raveling during the step operation.

FIGS. 61-64 illustrate alternate methods for producing a stepped panel 215 The operations include upper and lower tooling 258, 260. The step 215 is created as relative transverse movement between the upper and lower tools 268, 260 cause a convex annular arcuate portion 262 of the lower tool to cooperate with a concave annular portion 264 of the upper tool 258.

In these embodiments the convex annular arcuate portion 262 may have a radius of curvature $R_S$ of 0.01 ins. to 0.050 ins. (0.25 mm to 1.27 mm), more preferably 0.020 ins. to 0.030 ins. (0.51 mm to 0.76 mm), or any range or combination of ranges therein. A cross-sectional length $L_S$ of the concave annular portion 262 is large enough to accept a portion of the center panel 18 and as relative movement between the upper and lower tools 258, 260 causes the metal to be pushed into the concave annular portion 264. Preferably, the length $L_S$ is 0.01 ins. to 0.10 ins. (0.25 mm 2.54 mm), more preferably 0.070 ins. (1.78 mm), or any range or combination of ranges therein. The depth $H_S$ of the concave annular portion 264 is preferably 0.010 ins. to 0.020 ins. (0.25 mm to 0.51 mm), more preferably 0.015 ins. to 0.017 ins. (0.381 mm to 0.432 mm), or any range or combination of ranges therein. The radius of curvature $R_O$ of the concave annular portion 264 opening is preferably 0.01 ins. to 0.10 ins. (0.25 mm to 2.54 mm) and more preferably 0.01 ins. (0.25 mm), or a range or combination of ranges therein.

Figure 65:
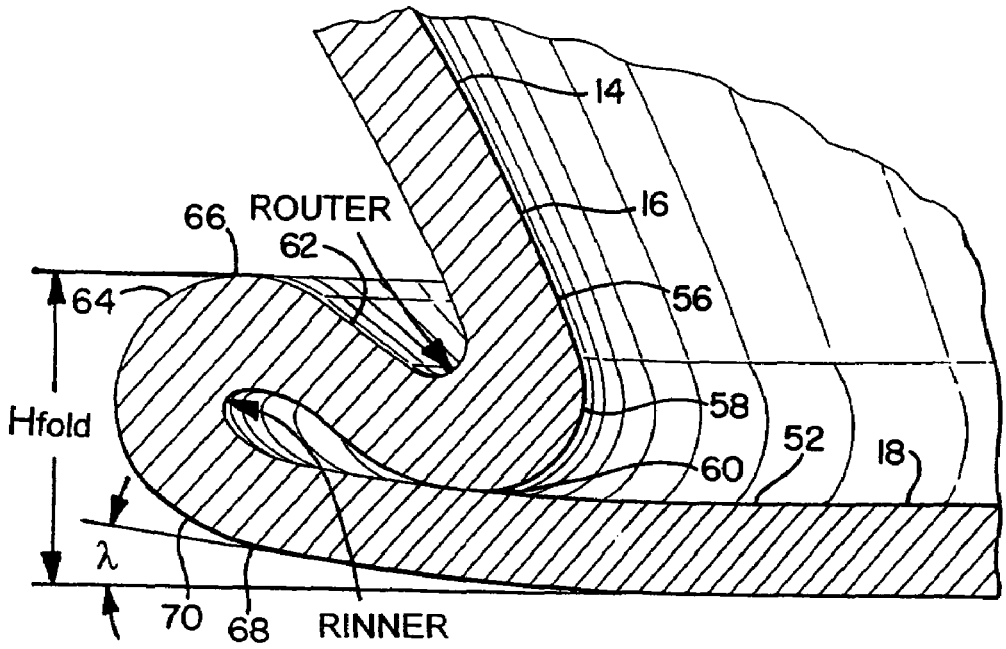
FIG. 65 is a partial cross-sectional view of a can end member having a fold.
Figure 66:
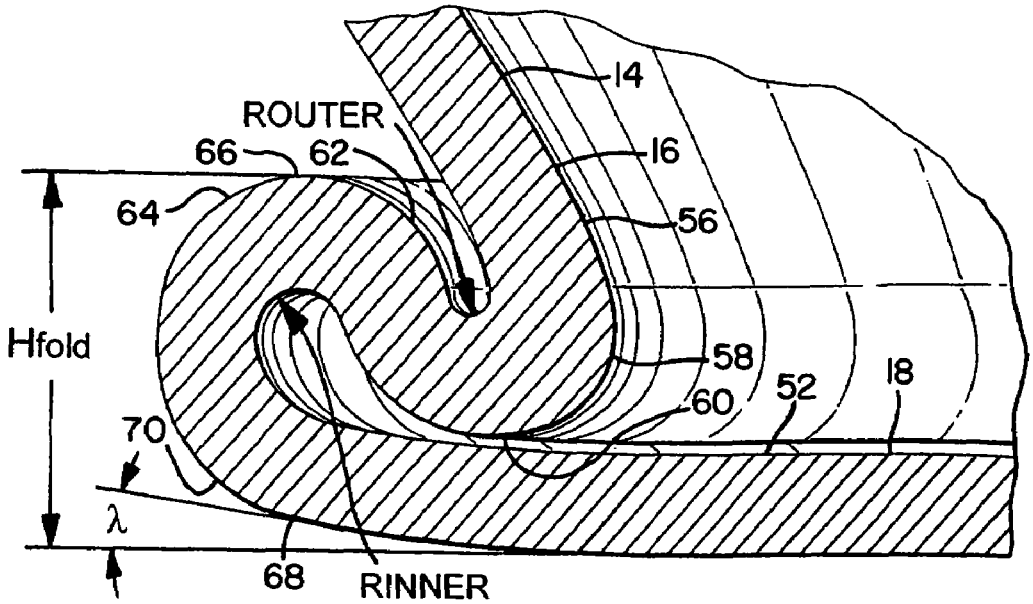
FIG. 66 is a partial cross-sectional view of an alternative can end member having a fold.

Now referring to FIGS. 65 and 66, in these embodiments, the fold 54 may not contact the center panel 18. Once the container is pressurized, the distance between the apex 60 and the center panel 18 is reduced or eliminated to create a clean end. As the fold 54 is circumferential, portions of the apex 60 may contact the center panel 18; the apex 60 may contact the center panel 18 along its entire circumference; or no portion of the apex 60 may contact the center panel 18.

The fold 54 has an inner radius of curvature $R_{inner}$ joining or connecting the second leg 62 with the third leg 68. The radius of curvature $R_{inner}$ is preferably 0 ins. to 0.030 ins. (0 mm to 0.76 mm); more preferably 0.002 ins. to 0.020 ins. (0.051 mm to 0.51 mm); still more preferably 0.0035 ins. to 0.010 ins. (0.089 mm to 0.25 mm); and most preferably 0.006 ins. (0.15 mm); or any range or combination of ranges therein.

The fold 54 has an outer radius of curvature $R_{outer}$ joining or connecting the first leg 56 with the second leg 62. The radius of curvature $R_{outer}$ is preferably less than the radius of curvature $R_{inner}$. The radius of curvature $R_{outer}$ is preferably 0 ins. to 0.030 ins. (0 mm to 0.76 mm); more preferably 0.002 ins. to 0.020 ins. (0.051 mm to 0.51 mm); still more preferably 0.0035 ins. to 0.010 ins. (0.089 mm to 0.254 mm); or any range or combination of ranges therein.

The second leg 62 and third leg 68 each have opposing first and second ends. The first end of the second leg 62 is joined to the concave annular portion 58; the opposing second end of the second leg 62 is joined to the convex annular portion 64; the first end of the third leg 68 is joined to the convex annular portion 64, and the opposing second end of the third leg 68 is interconnected to the center panel 18. The first end of the second leg 62 and the second end of the third leg 68 converge so that a distance between the apex 60 and the center panel 18 is reduced or eliminated, and the distance between the second end of the second leg 62 and the first end of the third leg 68 is greater than the distance between the first end of the second leg 62 and the second end of the third leg 68. The relative magnitudes of the radii of curvature $R_{inner}$ and $R_{outer}$ help create this spatial relationship which is believed to contribute significant increases in the strength of the can end 10. It is further believed that the strength of the can end 10 can be dramatically increased by forming the legs with a curvilinear shape, e.g. a radius of curvature or bow-shape, e.g. second leg 62, such that the convex annular portion 64 is positioned adjacent to or engages an outer surface of the chuck wall 14. (See, e.g., FIG. 40).

Improved buckle strength results as the radius $R_{inner}$ is greater than 0.002 ins. (0.051 mm). Buckle strength improves significantly as $R_{inner}$ is increased from 0.002 ins. to 0.006 ins. (0.051 mm to 0.15 mm) and higher. FIG. 66 illustrates the increase in $R_{inner}$ over $R_{inner}$ of FIG. 65. The fold 54 of FIG. 66 was formed in the shell press while the fold 54 of FIG. 65 was formed in the conversion press.

It is also desirable for $R_{inner}$ to be greater than or equal to $R_{outer}$. However, it is believed that $R_{outer}$ can be larger than $R_{inner}$ without adversely affecting buckle strength, and in some cases, buckle strength may be improved by such a relationship. This relationship could occur when the convex annular portion 64 is positioned adjacent to or engages an outer surface of the chuck wall 14.

A height $H_{fold}$ of the fold 54 above a horizontal plane defined by the lowest vertical extent of the center panel 18 is preferably a minimum of 0.035 ins. (0.89 mm). The height $H_{fold}$ can be increased by increasing $R_{inner}$ and/or increasing an angle $\lambda$ of the fold 54. The angle $\lambda$ is the angle at which the lowest vertical extent of the fold 54 is elevated above the horizontal plane defined by the lowest vertical extent of the center panel 18 and/or the peripheral edge 52 of the center panel. Preferably, the lowest vertical extent of the center panel 18 coincides with the peripheral edge 52 of the center panel 18. The angle $\lambda$ is between 0 and 90 degrees, preferably less than 60 degrees; more preferably less than 30 degrees; and most preferably 8 degrees; or any range or combination of ranges therein. Again, the magnitudes of the height $H_{fold}$ and the angle $\lambda$ are believed to contribute greatly to the strength of the can end 10.

Yet another important relationship is illustrated in FIGS. 65 and 66. The metallic material used to form the end member 10 is compressed in the fold area 54 as the fold 54 is formed.

This thickening results from compressive forces placed on the metal. The compressive forces are provided to prevent the fold 54 from fracturing during the forming process. The thickness along the concave annular portion 58 and the convex annular portion 64 is preferably 1 to 20 percent thicker than thickness of the metal in the center panel 18. More preferably, the thickness along the concave annular portion 58 and the convex annular portion 64 is preferably 10 to 20 percent thicker than thickness of the metal in the center panel 18.

Figure 67:
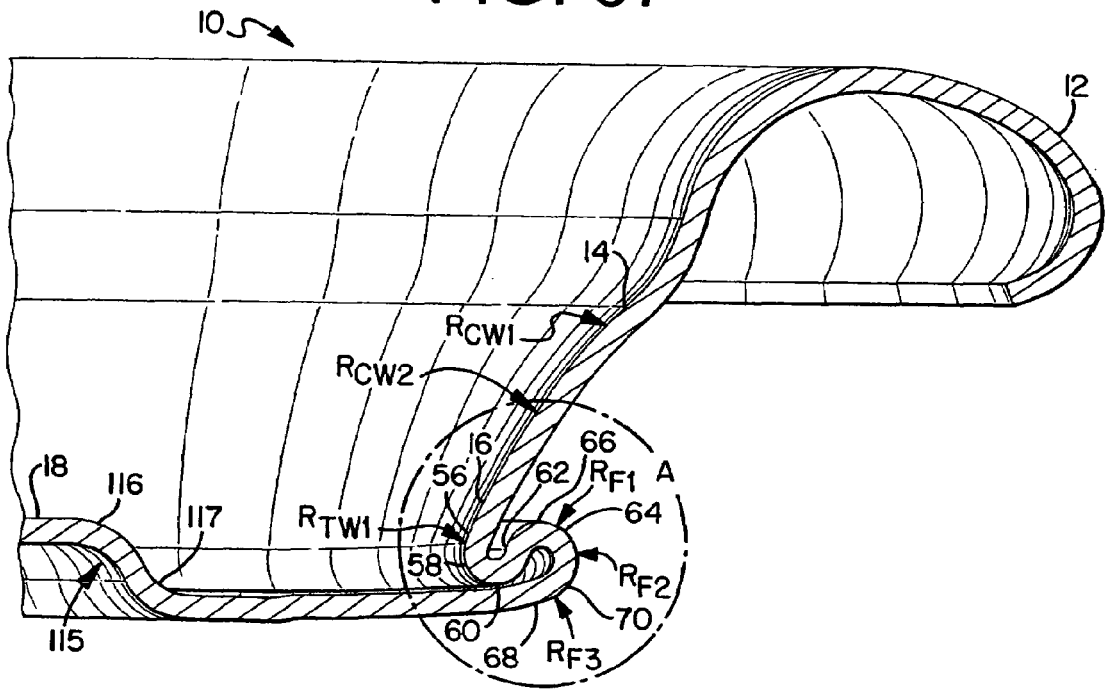
FIG. 67 is a partial cross-sectional view of a can end having a fold showing the various radii of curvature along the fold and the chuck wall.
Figure 67A:
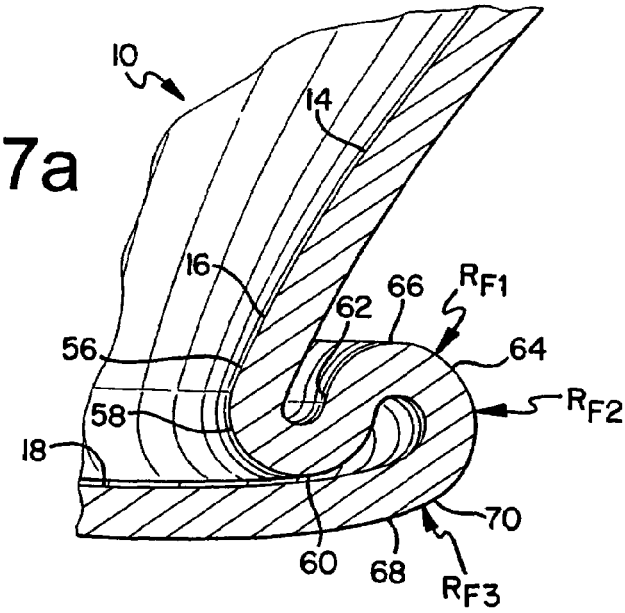
FIG. 67*a* is a partial enlarged view of the can end of FIG. 67.

Now referring to FIGS. 67 and 67*a*, various radii of curvature along the chuck wall 14 and the transition wall 16 are shown. The chuck wall 14 of this embodiment has a compound radius. An upper portion of the chuck wall 14 has a radius of curvature $R_{CW1}$ of about 0.100 ins. to 0.700 ins. (2.54 mm to 17.78 mm), preferably about 0.300 ins. (7.62 mm), or any range or combination of ranges therein. A lower portion of the chuck wall 14 has a radius of curvature $R_{CW2}$ of about 0.100 ins. to 0.600 ins. (2.54 mm to 15.24 mm), preferably slightly less than $R_{CW1}$ or about 0.200 ins. (5.08 mm), or any range or combination of ranges therein. The first leg 56 of the transition wall 16 has a radius of curvature $R_{TW1}$ of about 0.010 ins. to 0.150 ins. (0.254 mm to 3.81 mm), preferably less than $R_{CW2}$ or about 0.040 ins. (1.02 mm), or any range or combination of ranges therein.

The second leg 62, the annular convex portion 64, and the third leg 68 of this embodiment generally exhibit increasing radii of curvature along this segment of the fold 54. Accordingly, a first radius of curvature $R_{F1}$ is about 0.006 ins. to 0.040 ins. (0.15 mm to 1.02 mm), preferably about 0.0132 ins. (0.34 mm); a second radius of curvature $R_{F2}$ is also 0.006 ins. to 0.040 ins. (0.15 mm to 1.02 mm), but preferably slightly greater than $R_{F1}$ or about 0.0144 ins. (0.37 mm); a third radius of curvature $R_{F3}$ is about 0.010 ins. to 0.100 ins. (0.25 mm to 2.54 mm), preferably greater than $R_{F2}$ or about 0.0434 ins. (1.10 mm).

Several alternative embodiments have been described and illustrated. A person ordinary skilled in the art would appreciate that the features of the individual embodiments, for example, stay-on closures and center panel and chuck wall reforming can be applied to any of the embodiments. A person ordinary skilled in the art would further appreciate that any of the embodiments of the folded transition wall could be provided in any combination with the embodiments disclosed herein. Further, the terms "first," "second," "upper," "lower," etc. are used for illustrative purposes only and are not intended to limit the embodiments in any way. The term "plurality" as used herein is intended to indicate any number greater than one, either disjunctively or conjunctively as necessary, up to an infinite number. The terms "joined" and "connected" as used herein are intended to put or bring two elements together so as to form a unit, and any number of elements, devices, fasteners, etc. may be provided between the joined or connected elements unless otherwise specified by the use of the term "directly" and supported by the drawings.

This application includes numerous dimensional relationships which are directed to a 202 can end, namely those dimensions directed at radial placement of the fold and/or the step, the diameter or radius of the seaming curl and/or center panel, etc. One ordinary skilled in the art would recognize that these dimensions would change if the inventive aspects disclosed herein were applied to larger or smaller ends, including but not limited to 200, 206, and 209 can ends.

While the invention has been described with reference to preferred embodiments, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention should not be limited to such details.

We claim:

1. An easy open can end member comprising:

a center panel positioned about a longitudinal axis perpendicular to a diameter of the center panel, the center panel including a closure member for sealing the end member, a portion of the closure member is retainable to a portion of the center panel once the easy open can end member is opened;

a curl defining an outer perimeter of the end member;

a circumferential chuck wall extending downwardly from the curl; and a transition wall connecting the chuck wall with a peripheral edge of the center panel, the transition wall comprising a folded portion, the folded portion having a first leg, a second leg, and a third leg, the first leg connected to the chuck wall and joined to the second leg by a concave annular potion, the second leg joined to the third leg by a convex annular portion, and the third leg joined to the center panel, the convex annular portion having a radius of curvature greater than 0.002 ins.

2. The easy open can end member of claim 1 wherein the second leg extends upwardly and outwardly relative to the longitudinal axis.

3. The easy open can end member of claim 2 wherein the third leg extends inwardly relative to the longitudinal axis.

4. The easy open can end member of claim 3 wherein the first leg extends downwardly and inwardly relative to the longitudinal axis.

5. The easy open can end member of claim 4 wherein the third leg further extends downwardly.

6. The easy open can end member of claim 5 wherein an annular curved portion joins the third leg to the center panel.

7. The easy open can end of claim 1 wherein a first end of the second leg is joined to the concave annular portion, an opposing second end of the second leg is joined to the convex annular portion, a first end of the third leg is joined to the convex annular portion, and an opposing second end of the third leg is interconnected to the center panel, the first end of the second leg and the second end of the third leg converging.

8. The easy open can end member of claim 1 wherein the closure member is a displaceable tear panel.

9. An easy open can end member comprising:

a center panel positioned about a longitudinal axis perpendicular to a diameter of the center panel, the center panel including a closure member for sealing the end member, a portion of the closure member is retainable to a portion of the center panel once the easy open can end member is opened;

a curl defining an outer perimeter of the end member;

a circumferential chuck wall extending downwardly from the curl; and a transition wall connecting the chuck wall with a peripheral edge of the center panel, the transition wall comprising a folded portion, the folded portion having an upper vertical extent at least 0.035 ins. above a lower vertical extent of the center panel and located radially outwardly of a radially innermost portion of the chuck-wall.

10. The easy open can end member of claim 9 wherein the folded portion comprises a first leg, a second leg, and a third leg, the first leg directly connected to the chuck wall and joined to the second leg by a concave annular portion, the second leg joined to the third leg by a convex annular portion, and the third leg joined to the center panel, the vertically upper extent of the folded portion comprising a portion of the convex annular portion.

11. The easy open can end of claim 9 wherein the folded portion extends upwardly above a horizontal plane defined by the lower vertical extent of the center panel at an angle greater than 1 degree.

12. The easy open can end member of claim 11 wherein the folded portion comprises a first leg, a second leg, and a third leg, the first leg directly connected to the chuck wall and joined to the second leg by a concave annular portion, the second leg joined to the third leg by a convex annular portion, and the third leg joined to the center panel, the vertically upper extent of the folded portion comprising a portion of the convex annular portion.

13. The easy open can end member of claim 12 wherein a portion of the convex annular portion has a radius of curvature greater than 0.002.

14. The easy open can end of claim 9 wherein a first end of the second leg is joined to the concave annular portion, an opposing second end of the second leg is joined to the convex annular portion, a first end of the third leg is joined to the convex annular portion, and an opposing second end of the third leg is interconnected to the center panel, the first end of the second leg and the second end of the third leg converging.

15. An easy open can end member comprising:

a center panel positioned about a longitudinal axis perpendicular to a diameter of the center panel, the center panel including a closure member for sealing the end member, a portion of the closure member is retainable to a portion of the center panel once the easy open can end member is opened;

a curl defining an outer perimeter of the end member;

a circumferential chuck wall extending downwardly from the curl; and a transition wall connecting the chuck wall with a peripheral edge of the center panel, the transition wall comprising a folded portion, the folded portion having a first leg, a second leg, and a third leg, the first leg connected to the chuck wall and joined to the second leg by a concave annular portion, the second leg joined to the third leg by a convex annular portion, and the third leg joined to the center panel, the convex annular portion having a radius of curvature greater than a radius of curvature of the concave annular portion.

16. The easy open can end of claim 15 wherein a first end of the second leg is joined to the concave annular portion, an opposing second end of the second leg is joined to the convex annular portion, a first end of the third leg is joined to the convex annular portion, and opposing second end of the third leg is interconnected to the center panel, the first end of the second leg and the second end of the third leg converging.

17. The easy open can end of claim 15 wherein the folded portion extends upwardly above a horizontal plane defined by the lower vertical extent of the center panel at an angle greater than 1 degree.

18. The easy open can end member of claim 15 wherein a portion of the convex annular portion has a radius of curvature greater than 0.002 ins.

19. The easy open can end member of claim 15 wherein a portion of the concave annular portion has a radius of curvature less than 0.030 ins.

20. The easy open can end member of claim 15 wherein a portion of the convex annular portion has a radius of curvature greater than 0.002 ins., and a portion of the concave annular portion has a radius of curvature less than 0.030 ins.

21. The easy open can end member of claim 15 wherein the folded portion has an upper vertical extent at least 0.035 ins, above a lower vertical extent of the center panel.

22. An easy open can end member comprising:

a center panel positioned about a longitudinal axis perpendicular to a diameter of the center panel, the center panel including a closure member for sealing the end member, a portion of the closure member is retainable to a portion of the center panel once the easy open can end member is opened;

a curl defining an outer perimeter of the end member;

a circumferential chuck wall extending downwardly from the curl; and a transition wall connecting the chuck wall with a peripheral edge of the center panel, the transition wall comprising a folded portion, the folded portion having a first leg and a second leg wherein a first end of the first leg is joined to a concave annular portion, an opposing second end of the first leg is joined to a convex annular portion, a first end of the second leg is joined to the convex annular portion, and an opposing second end of the second leg is interconnected to the center panel, the first end of the first leg and the second end of the second leg converging.

* * * * *